US006935919B2

(12) United States Patent
Fong

(10) Patent No.: US 6,935,919 B2
(45) Date of Patent: Aug. 30, 2005

(54) ANIMATION DEVICE FOR HEAD, MOUTH, ARMS AND BODY OF A TOY

(76) Inventor: Peter Sui Lun Fong, 297F S. Atlantic Blvd., Monterey Park, CA (US) 91754

( * ) Notice: Subject to any disclaimer, the term of this patent is extended or adjusted under 35 U.S.C. 154(b) by 0 days.

(21) Appl. No.: 10/621,544

(22) Filed: Jul. 17, 2003

(65) Prior Publication Data

US 2004/0198160 A1 Oct. 7, 2004

Related U.S. Application Data

(63) Continuation-in-part of application No. 10/127,241, filed on Apr. 22, 2002, now Pat. No. 6,616,503.

(51) Int. Cl.[7] ..... A63H 3/20
(52) U.S. Cl. ..... 446/330; 446/353
(58) Field of Search ..... 74/421 A, 567, 74/569, 606 R, 665 H, 665 P, 665 A; 446/330, 352, 353, 354, 355, 268; 40/420, 419, 414

(56) References Cited

U.S. PATENT DOCUMENTS

| | | | | | |
|---|---|---|---|---|---|
| 3,597,878 | A | * | 8/1971 | Iwasaki et al. | 446/355 |
| 4,673,371 | A | * | 6/1987 | Furukawa | 446/353 |
| 4,717,364 | A | * | 1/1988 | Furukawa | 446/175 |
| 4,775,352 | A | * | 10/1988 | Curran et al. | 446/301 |
| 4,828,530 | A | | 5/1989 | Lee | |
| 4,869,703 | A | | 9/1989 | Ong | |
| 4,878,875 | A | * | 11/1989 | Pin-Hung et al. | 446/356 |
| 5,413,517 | A | | 5/1995 | Kamijima | |
| 5,823,845 | A | * | 10/1998 | O'Berrigan | 446/355 |
| 5,855,502 | A | * | 1/1999 | Truchsess | 446/301 |
| 5,966,853 | A | | 10/1999 | Yeh | |
| 6,017,261 | A | | 1/2000 | Wachtel | |
| 6,036,572 | A | * | 3/2000 | Sze | 446/330 |
| 6,135,848 | A | | 10/2000 | Hou | |
| 6,149,490 | A | * | 11/2000 | Hampton et al. | 446/353 |
| 6,149,491 | A | * | 11/2000 | Arad et al. | 446/354 |
| 6,343,970 | B1 | | 2/2002 | Lee et al. | |
| 6,352,464 | B1 | * | 3/2002 | Madland et al. | 446/337 |
| 6,454,626 | B1 | * | 9/2002 | An | 446/330 |

* cited by examiner

*Primary Examiner*—Derris H. Banks
*Assistant Examiner*—Urszula M. Cegielnik
(74) *Attorney, Agent, or Firm*—Stetina Brunda Garred & Brucker

(57) ABSTRACT

An animation device is provided for generating movements of limbs and extremities of an animated figure. The device includes a single motor coupled to a gear box assembly. A first drive axle, rotatable about a first axis, is coupled to the gear box assembly. A second drive axle, rotatable about a second axis and oriented substantially perpendicular to the first drive axle, is also coupled to the gear box assembly. A gear train assembly is coupled to a lower end of the second drive axle and an output drive shaft is coupled to the gear drain assembly. The output drive shaft is rotatable about a third axis oriented parallel to and offset from the second axis. A left cam is coupled to a left end of the first drive axle and a right cam is coupled to a right end of the first drive axle, both of which are configured for radial movement about the first drive axle when the motor is activated. A middle cam is coupled to a middle section of the second drive axle, and is configured for radial movement about the second drive axle when the motor is activated. And, a lower cam is coupled to the output drive shaft, and is configured for radial movement about the output drive shaft when the motor is activated.

28 Claims, 31 Drawing Sheets

ANIMATION DEVICE FOR HEAD, MOUTH, ARMS AND BODY OF A TOY

CROSS REFERENCE TO RELATED APPLICATIONS

The present application is a Continuation-In-Part of U.S. application Ser. No. 10/127,241, filed on Apr. 22, 2002 now U.S. Pat. No. 6,616,503, entitled "Animation Device for Head and Mouth of a Toy", the content of which is expressly incorporated by reference herein in its entirety.

BACKGROUND OF THE INVENTION

1. Field of the Invention

The present invention relates generally to animated figures, and more particularly, to a compact, inexpensive animation device for imparting realistic, life-like movements to the head, mouth, arms, and body of a figure or toy.

2. Background of the Invention

There have been known for many years various types of animated figures and toys which are capable of performing various movements in sequences and/or combinations so as to convey a life-like appearance. Such animated figures are often found in amusement parks, with more simplified animated toys being made available commercially in many toy stores or toy departments of various retail establishments. The animated figures often seen in amusement parks are generally of extremely complex construction, including many motors which facilitate the movements of various body parts of the figure (e.g., the head, eyes, mouth, arms, body, legs, etc.). The control of these numerous motors is typically facilitated by a central processor which is programmed to coordinate the actuation of the motors as needed to impart to the animated figure life-like movements. As will be recognized, these animated figures are highly sophisticated, expensive devices, typically unsuitable for the consumer market.

Those animated figures (e.g., toys) which are suited for the consumer markets are substantially less complex, and thus, substantially less expensive than the aforementioned "amusement park" animated figures. In this regard, animated figures that are currently available, such as dolls and soft toy animals, are typically provided with one or more motors capable of facilitating a limited range of movement of one or more corresponding body parts of the figure. The animated figures which include a single motor to facilitate movement of a corresponding body part tend to be less expensive, but are extremely limited in their ability to provide life-like movements to the figure. Animated figures or dolls which include multiple motors facilitating the movement of multiple body parts, while imparting a more life-like movement pattern and appearance to the figure, tend to be extremely costly due to the large number of motors included in the device, and hence, more prone to failure since the failure of even a single motor may compromise the functionality of the entire device It would be desirable to provide an animation device which is capable of providing movement and motion in various directions for the head, mouth, arms and body of a toy; yet, the animation device must be inexpensive to produce, reliable, and have a limited amount of expensive components. In this regard, it would be advantageous to provide a reliable animation device capable of producing numerous motions while utilizing minimum number of electrical motors.

SUMMARY OF THE INVENTION

The present invention addresses these and other deficiencies of animated figures, soft toy animals, and dolls currently available to consumers by providing an animation device for imparting to a toy such as a doll or a soft toy animal, realistic life-like head, mouth, arm and body movements.

An aspect of the present invention is to provide a multitude of animation features, such as head, mouth, arms and body movement of a figure, in a reliable package, while at the same time utilizing a minimum amount of expensive components. To accomplish this task, a first component referred to as a head and mouth animation device is provided with a single motor to generate head and mouth movement. Moreover, a second component referred to as a lower drive unit is provided with a single motor to provide arms and body movement. By minimizing the amount of motors on the animation device, and yet providing numerous degrees of freedom, production costs can be reduced, allowing the animation device to sold at a reasonable rate. Furthermore, the reliability of the animation device can be improved if fewer electric motors are utilized.

The present invention overcomes the aforementioned disadvantages by providing at least six different types of body movements for a figure, while utilizing only two inexpensive electrical motors. Movements derived from the head and mouth animation device include movement of: (1) a lower jaw of the figure between open and closed mouth positions; (2) tilting the head of a figure forward or backward; and (3) tilting of the head of a figure to the right or to the left. Movements derived from the lower drive unit include: (4) twisting or rotational movement of an upper assembly or body portion about a vertical axis, (5) movement of arms of the figure in a motion which resembles the motion of human arms when the human is running; and (6) movement of a midbody perimeter hoop in a twisting, up and down, gyrating and erratic jerking motion.

In particular, an exemplary embodiment of the present invention is an animation device for generating movements of limbs and extremities of an animated figure. The animated device includes a single motor coupled to a gear box assembly. A first drive axle coupled to the gear box assembly is provided, wherein the first drive axle is rotatable about a first axis. A second drive axle is also coupled to the gear box assembly, in which the second drive axle is rotatable about a second axis and oriented substantially perpendicular to the first drive axle. A gear train assembly is coupled to a lower end of the second drive axle and an output drive shaft is coupled to the gear drain assembly. Moreover, the output drive shaft is rotatable about a third axis oriented parallel to and offset from the second axis. A left cam is coupled to a left end of the first drive axle and a right cam is coupled to a right end of the first drive axle. Both the left and right cams are configured for radial movement about the first drive axle when the motor is activated. Furthermore, a middle cam is coupled to a middle section of the second drive axle and configured for radial movement about the second drive axle when the motor is activated. And, a lower cam is coupled to the output drive shaft, wherein the lower cam is configured for radial movement about the output drive shaft when the motor is activated.

According to another aspect of the present invention, the left cam is cooperatively attached to a left arm movement link cooperatively attached to a left arm assembly, wherein motion is induced in the left arm assembly when the motor is activated. Furthermore, the right cam is cooperatively attached to a right arm movement drive link cooperatively attached a right arm assembly, wherein motion is induced in the right arm assembly when the motor is activated.

According to another aspect of the present invention, a left arm assembly is provided containing a left shoulder axle having a left inboard retaining boss rotatably attached to a left shoulder bearing journal fixed to the animation device to form a left shoulder joint. A left input cam is coupled to a center section of the left shoulder axle, the left input cam swivel is attached to an upper end of the left arm movement link, and a left output cam is coupled to an outboard end of the left shoulder axle. Moreover, the left output and input cams are configured for simultaneous radial movement about the left shoulder axle, a left arm link swivel is attached to the left output cam, and a left forearm cam having a left forearm follower is integrally formed with the left forearm cam. Furthermore, motion is induced in the left forearm follower when the motor is activated.

In yet another aspect of the present invention, a right arm assembly is provided containing a right shoulder axle having a right inboard retaining boss rotatably attached to a right shoulder bearing journal fixed to the animation device forming a right shoulder joint. A right input cam is coupled to a center section of the right shoulder axle, the right input cam is swivel attached to an upper end of the right arm movement link, and right output cam is coupled to an outboard end of the right shoulder axle. The right output and input cams are configured for simultaneous radial movement about the right shoulder axle, a right arm link is swivel attached to the right output cam, and a right forearm cam having a right forearm follower is integrally formed with the right forearm cam, wherein motion is induced in the right forearm follower when the motor is activated.

Further aspects of the invention include a hoop movement cam cooperatively attached to an inner hub connected to a midbody perimeter outer frame by a plurality of spokes. The hoop movement cam is able to induce at least one of gyrating, jerking, tilting, up and down, and rotating movement of the midbody perimeter outer frame when the motor is activated.

According to a still a further aspect of the present invention, the lower cam is cooperatively attached to an arcuate shaped lower cam receiving slot formed in a surface of a housing assembly, in which the receiving slot induces an upper assembly of the animation device to rotate in a back and forth motion when the fourth cam is radially rotated about the third axis when the motor is activated.

In another embodiment of the present invention, an animation device is provided for generating movement of limbs and extremities of the animated figure. The animation device includes a lower motion unit, an upper motion unit, and a chassis adapted to internally house and support the lower and upper motion units. The lower motion unit includes a first motor coupled to a gear box assembly, a first drive axle coupled to the gear box assembly, wherein the first drive axle is rotatable about a first axis. A second drive axle is also coupled to the gear box assembly, in which the second drive axle is rotatable about a second axis, and the second drive axle is oriented substantially perpendicular to the first drive axle. Moreover, a gear train assembly is coupled to a lower end of the second drive axle with an output drive shaft coupled to the gear drain assembly, such that the output drive shaft is rotatable about a third axis oriented parallel to and offset from the second axis. Further, a left cam is coupled to a left end of the first drive axle and a right cam is coupled to a right end of the first drive axle. Both the left and right cam are configured for simultaneous radial movement about the first drive axle when the first motor is activated. Also, a middle cam is coupled to a middle section of the second drive axle, wherein the middle cam is configured for radial movement about the second drive axle when the first motor is activated. And, a lower cam is coupled to the gear train assembly, wherein the lower cam is configured for radial movement about the third axis when driven by the first motor. Furthermore, the upper motion unit includes, an upper cam cooperatively engaged to a jaw, wherein the upper cam is configured for linear movement along a fourth axis concurrently with pivotal movement about fifth and six axes which are both normal to the fourth axis and to each other. Moreover, a motor is coupled to the upper cam and operative to facilitate the movement thereof along the fourth axis concurrently with movement about the fifth and sixth axes.

In another aspect of the present invention, the upper cam cooperatively engages to the jaw such that movement of the upper cam about the fourth axis facilitates movement of the jaw between open and closed positions. With this aspect, movement of the upper cam about the fifth axis facilitates movement of a head portion in an arcuate path between left and right positions, and movement of the upper cam about the sixth axis facilitates movement of the head in an arcuate path between forward and backward positions.

Additionally, other aspects of the present invention include the left and right cam each having an arm movement link cooperatively connected to a respective left and right moveable arm to produce a back and forth swinging motion in the moveable arms. In yet another aspect of the present invention, the middle cam is cooperatively connected to an inner hub of a midbody perimeter hoop to produce a twisting, up and down, gyrating and erratic jerking motion of the midbody perimeter hoop.

In yet a further aspect of the present invention, a center axis of the midbody perimeter hoop is offset from the second axis, and furthermore, the center axis is tilted with respect the second axis. According to another aspect of the present invention, the lower motion unit, upper motion unit, and a chassis comprise an upper assembly of the animation device. Furthermore, a lower assembly includes a housing having a planar base and is covered by a revolving plate interconnected to a bottom side of the upper assembly.

Another aspect of the present invention provides a lower cam engaged to an arcuate shaped receiving slot integrally formed within the planar base to produce a back and forth rotational motion of the upper assembly about the second axis.

According to still a further embodiment of the present invention, an animation device is provided having a body composed of an upper assembly, midbody section, and lower assembly. The upper assembly has a moveable head with a movable lower jaw hinged to the head, and pair of moveable arms cooperatively attached to a respective pair of shoulders on the upper assembly. The upper assembly further includes an upper drive unit disposed within the upper assembly having a first electric motor coupled to a first gear train, the first gear train is coupled to a first at least one cam and follower set, with the first at least one cam and follower set cooperatively connected to the moveable head and the lower jaw to produce an up and down jaw movement and tilting of the head in a back and forth direction and side to side direction. Also, a lower drive unit is disposed within the upper assembly having a second electric motor coupled to a second gear train, with a second gear train coupled to a second at least one cam and follower set cooperatively connected to the pair of moveable arms to produce a back and forth swinging movement in the pair of moveable arms. A midbody section is rigidly connected to the upper assembly and rotatably connected to the lower assembly by a revolving plate, wherein the midbody has a midbody perimeter hoop defining an extremity of the body. The midbody section further includes a third at least one cam and follower set coupled to the first gear train, where the third at least one cam and follower set is cooperatively connected to the midbody perimeter hoop to produce at least one of a twisting, up and down, gyrating and erratic jerking motion of the midbody section. And the aforementioned embodiment further includes a lower assembly having a base adapted to support the body to a substantially horizontal planar surface. The lower assembly includes a third gear train disposed within coupled to a driveshaft coupled to the first gear train, and a fourth at least one cam and follower set cooperatively transferring motion to the revolving plate to produce a back and forth rotation of the upper assembly and the midbody about an axis defined by the driveshaft.

According to another aspect of the present invention, the animation device includes a programmable central processing unit for (1) programming specific dance routines dictated by motions produced by the animation device, (2) specific audible sounds, and (3) operational modes of which the animation device performs to accordingly.

Another aspect of the present invention includes a motion detector which activates the animation device when motion is detected by the detector. A still further aspect of the invention is an infrared transmitting and receiving feature allowing the animation device to send and receive data over a wireless infrared connection. Other aspects of the invention include a body adapted to be exteriorly attached to the animation device. Also, an aspect of the present invention, is that the body is a Christmas tree figure.

Another aspect of the present invention includes a clutch release mechanism integrated into the driveshaft between the second gear train and the third gear train to prevent damage to the animation device when moving parts of the animated device are inappropriately forced to be moved by a user of the animated device.

Another embodiment of the present invention includes an animation device including a first motor coupled to a first gear train having a first and second output shaft in which the output shafts are configured perpendicular to each other. A left cam is radially connected to a left end of the first output shaft wherein the left cam drives a left follower to induce motion in a left arm assembly. A right cam is radially connected to a right end of the first output shaft so that the right cam drives a right follower to induce motion in a right arm assembly. And a middle cam is radially connected to the output shaft so that the middle cam drives a middle follower to induce motion in a midbody perimeter hoop.

According to another aspect of the present invention, a first input shaft is coupled to a center axis of the middle cam on one end and coupled to a second gear train on the other end. The second gear train has a third output shaft and a lower cam radially connected to the third output shaft. Moreover, the lower cam is interconnected with a lower cam receiving slot for inducing a rotational motion in an upper assembly of said animation device.

And yet another aspect of the present invention includes the animation device being composed of an upper assembly, midbody section, and lower assembly, wherein th first motor, first gear train, left cam, left follower, right cam, and right follower are contained within the upper assembly; and wherein the middle cam, the middle follower, and midbody perimeter hoop are exteriorly located proximate the midbody section. Another aspect of the present invention include the second gear train, third output shaft, lower cam, and lower cam receiving slot being contained within the lower assembly.

And yet still, another embodiment of the animation device is provided which includes an upper assembly rotatably interconnected to a lower assembly by a midbody section. The upper section includes a first motor coupled to a first gear train having a first and second output shaft wherein the output shafts are configured perpendicular to each other. A left cam is radially connected to a left end of the first output shaft, wherein the left cam drives a left follower to induce motion in a left arm assembly; and similarly, a right cam is radially connected to a right end of the first output shaft, wherein the right cam drives a right follower to induce motion in a right arm assembly. Also, a middle cam is provided and radially connected to the output shaft. The middle cam drives a middle follower to induce motion in a midbody perimeter hoop. The middle cam, middle cam follower, and midbody perimeter hoop are located within the midbody section between the upper assembly and lower assembly.

According to another aspect of the present invention, a first input shaft is coupled to a second gear train having a third output shaft, a lower cam is radially connected to the third output shaft, the lower cam is interconnected with a lower cam receiving slot for inducing a rotational motion in the upper assembly of the animation device, wherein the second gear train, lower cam, and cam lower receiving slot are contained within said lower assembly. And yet, another aspect of the present invention includes the middle cam, middle follower and midbody perimeter hoop being mounted to an exterior of the animation device proximate of the midbody section.

These aforementioned embodiments, aspects and features of the present invention will be discussed in greater detail below.

BRIEF DESCRIPTION OF THE DRAWINGS

The present invention is further described in the detailed description that follows, by reference to the noted drawings by way of non-limiting examples of preferred embodiments of the present invention, in which like reference numerals represent similar parts throughout several views of the drawings, and in which.

DETAILED DESCRIPTION OF THE PRESENT INVENTION

Figure 1:
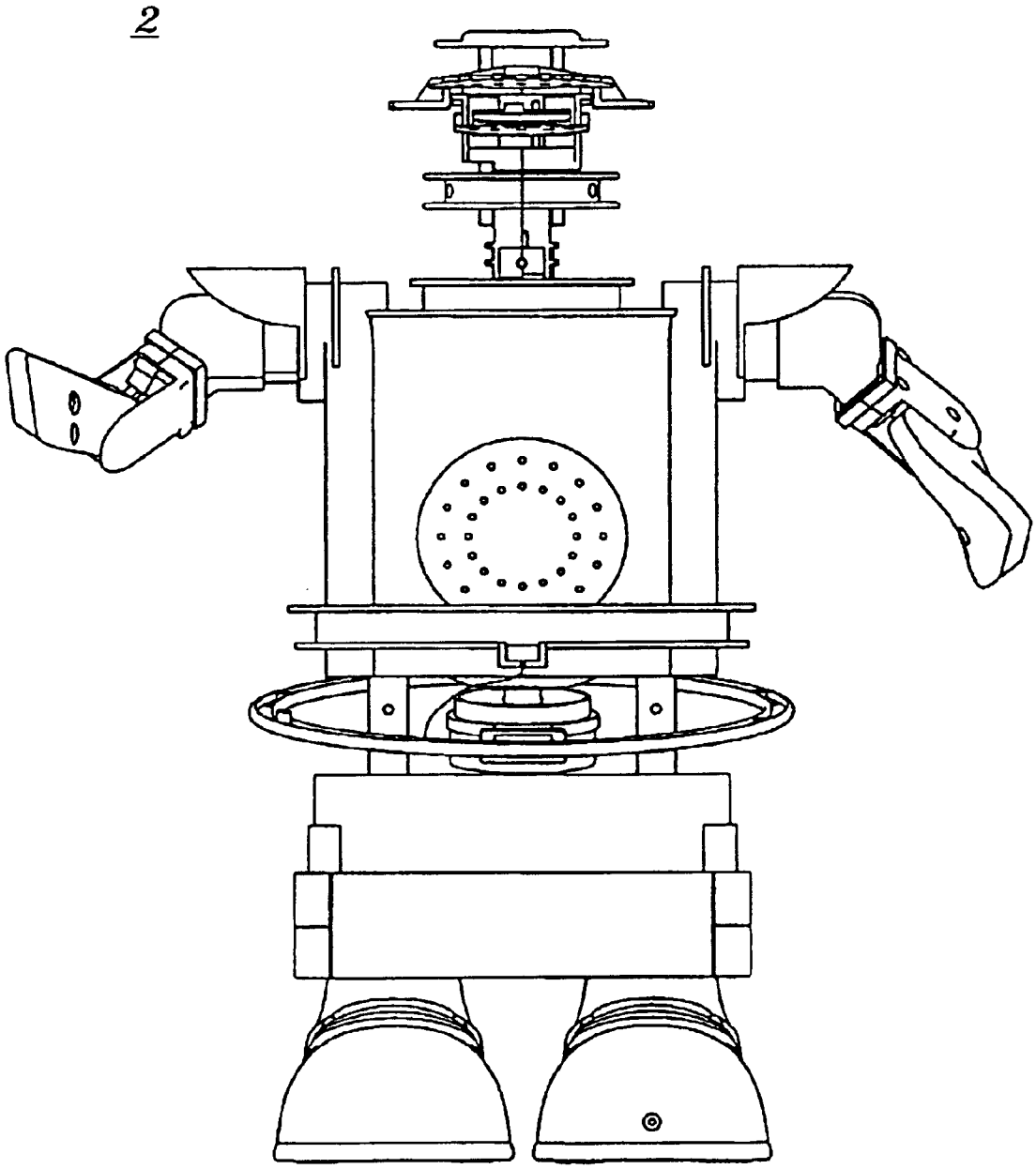
FIG. 1 shows a front view of an exemplary embodiment of an animation device for head, mouth, arms and body of a toy.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

A. General Description of Exemplary Embodiment of Animation Device

Referring now to the drawings wherein the showings are for purposes of illustrating a preferred embodiment of the present invention only, and not for purposes of limiting the same, FIGS. 1–31 provide various views of animation device 2 constructed in accordance with an exemplary embodiment the present invention. It is contemplated that animation device 2 will be integrated into an animated figure or toy, such as a doll or soft toy animal (see FIGS. 9 & 10). As will be discussed in more detail below, animated device 2 is specifically adapted to impart to an animated figure (or doll) various head, mouth, arm and body movements which create an animated, life-like effect.

The animated movements may be performed by animation device 2 may occur simultaneously, or in various sequences, depending on the desired animation effect. The control and coordination of such movement(s) is facilitated by a central processing unit 284 (e.g., a microprocessor) as will also be discussed in more detail later in the specification. Animation device 2 is able to impart the various movements to the animated figure, soft toy animal or doll through the use of only two electric motors. Thus, the animated figure including animation device 2 is considerably more simplified in construction. As a result, animation device 2 will be less costly to manufacture than those known in the prior art, more reliable, while at the same time providing superior animated effects.

The invention will now be described according to FIGS. 1–31. FIGS. 1–4 show a front, rear, left side, and right side view of an exemplary embodiment of an animation device 2 for head, mouth, arms and body of a toy. Also provided is FIG. 5A which depicts a top view and FIG. 5B which depicts a bottom view of animation device 2. Animation device 2 comprises several main components, each of which will be described in detail below.

Figure 6A:
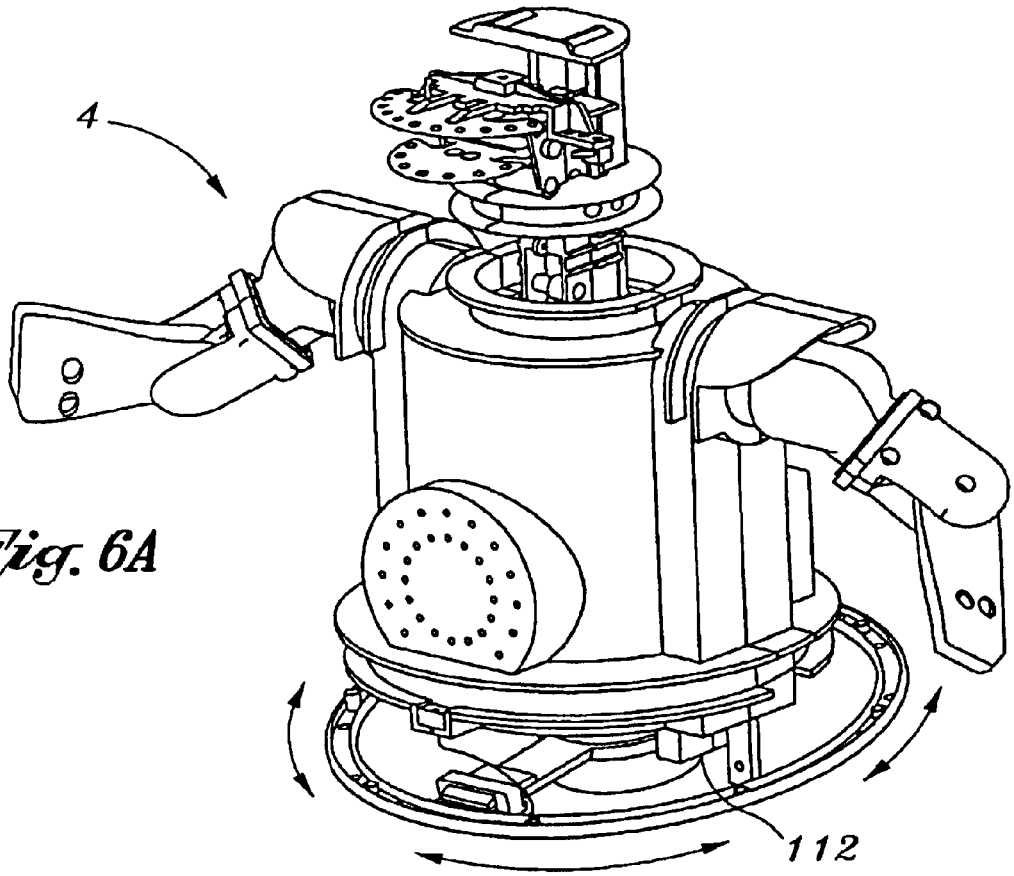
FIG. 6A is a front upper left side perspective view of an upper assembly of the exemplary embodiment of the animation device.
Figure 6B:
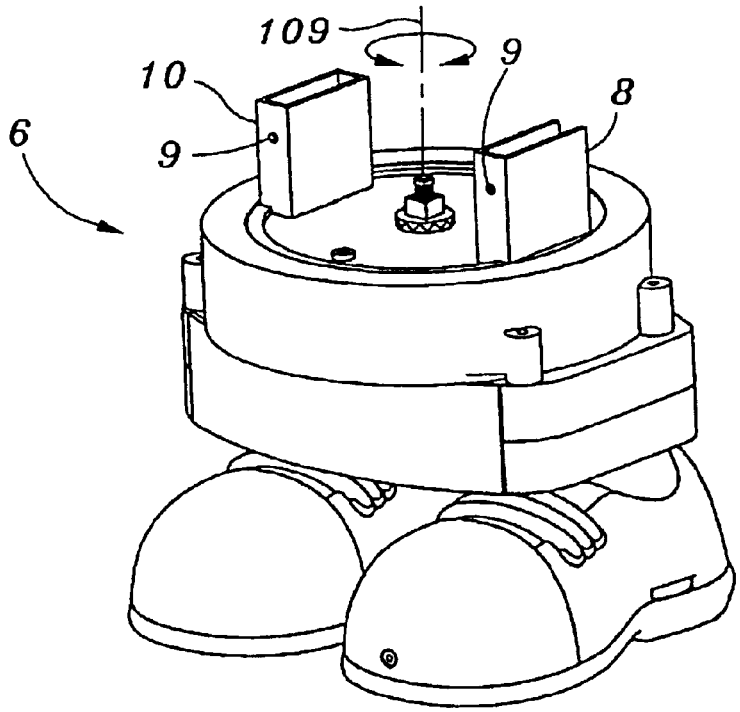
FIG. 6B is a front upper left side perspective view of a lower assembly of the exemplary embodiment of the animation device.

FIGS. 6A and 6B is a front upper left side perspective view of the exemplary embodiment of the animation device separated into two main assemblies. FIG. 6A depicts an upper assembly 4 and FIG. 6B depicts a lower assembly 6. Both units are interconnected by simultaneously sliding left connecting box 12 (see also FIG. 8A) and right connecting box 14 into left receiving connecting structure 8 and right connecting structure 10, respectively, and then securing the aforementioned features together with fastening hardware via fastening apertures 9.

Figure 7A:
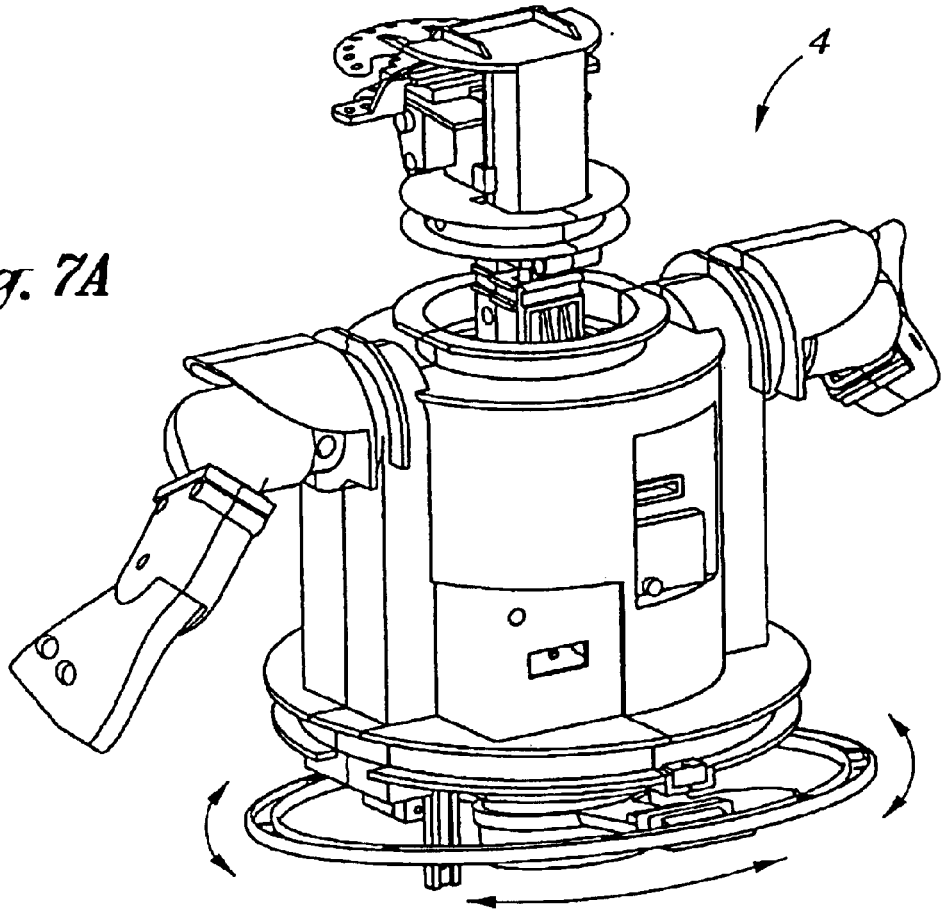
FIG. 7A is a rear upper left side perspective view of the upper assembly of the exemplary embodiment of the animation device.
Figure 7B:
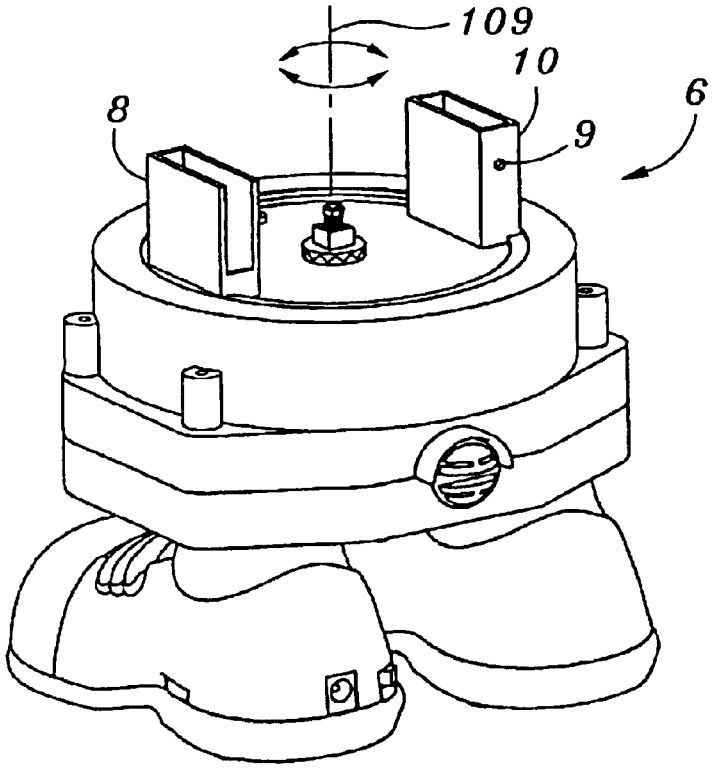
FIG. 7B is a rear upper left side perspective view of the lower assembly of the exemplary embodiment of the animation device.
Figure 8A:
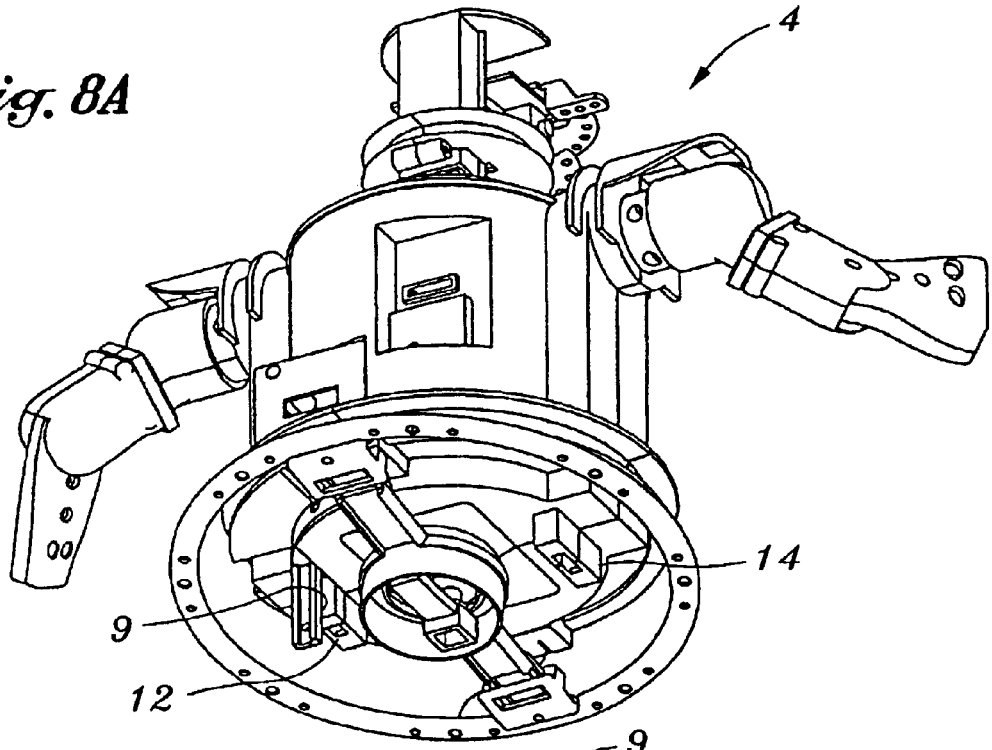
FIG. 8A is a rear lower right side perspective view of the upper assembly of the exemplary embodiment of the animation device.
Figure 8B:
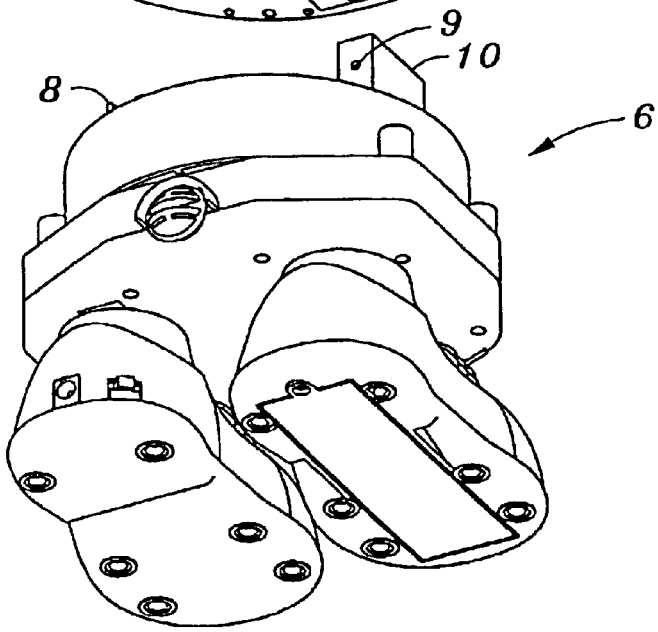
FIG. 8B is a rear lower right side perspective view of the lower assembly of the exemplary embodiment of the animation device.

FIGS. 7A and 7B are rear upper left side perspective views of upper assembly 4 and lower assembly 6 of the exemplary embodiment of animation device 2. FIGS. 8A and 8B are rear lower right side rear perspective views of upper assembly 4 and lower assembly 6 of animation device 2. From this vantage point, left connecting box 12 and right connecting box 14 are clearly visible.

Figure 9:
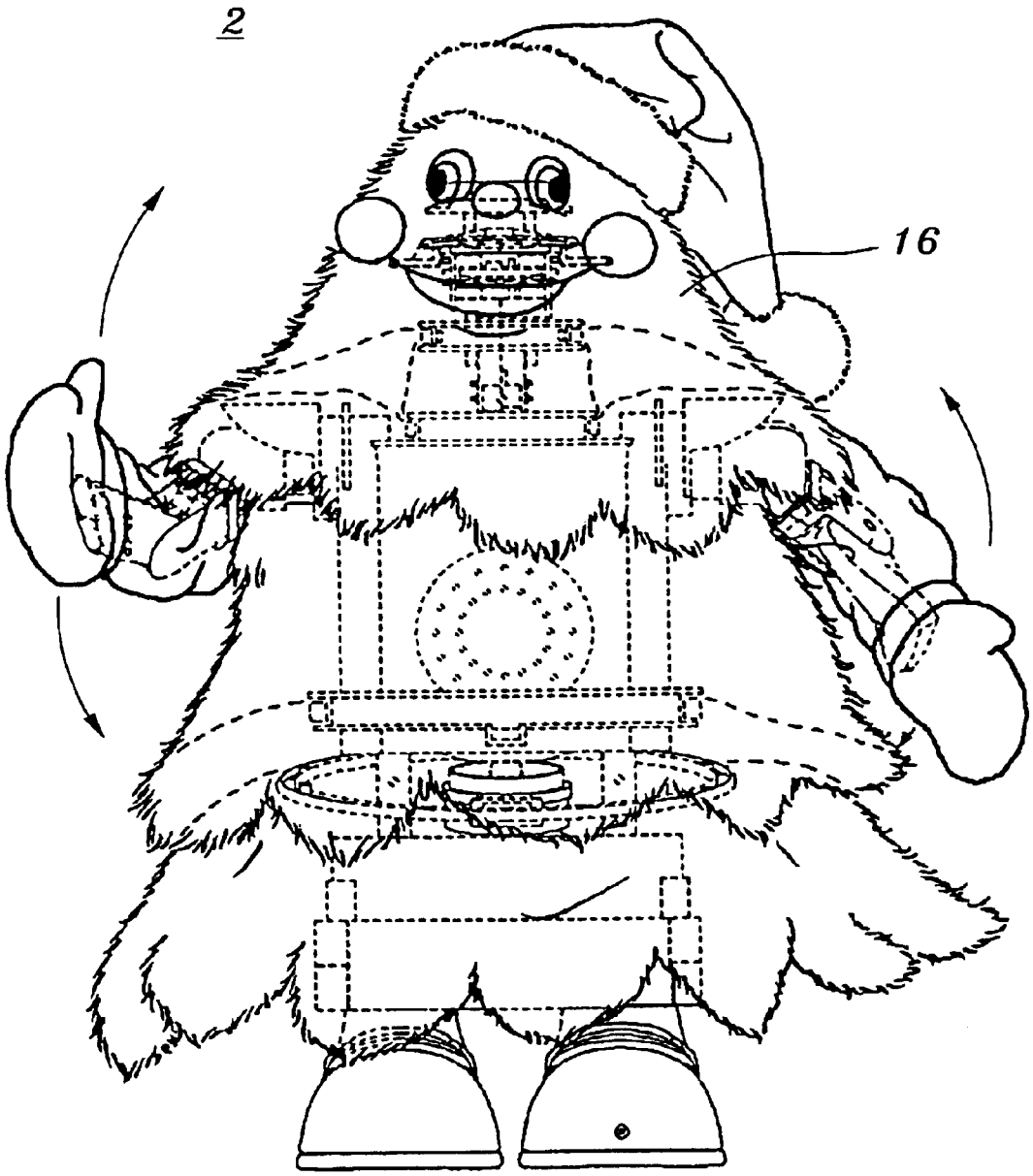
FIG. 9 is a second exemplary embodiment of the animation device with a Christmas tree exterior body illustrating the animation device in hidden lines.
Figure 10:
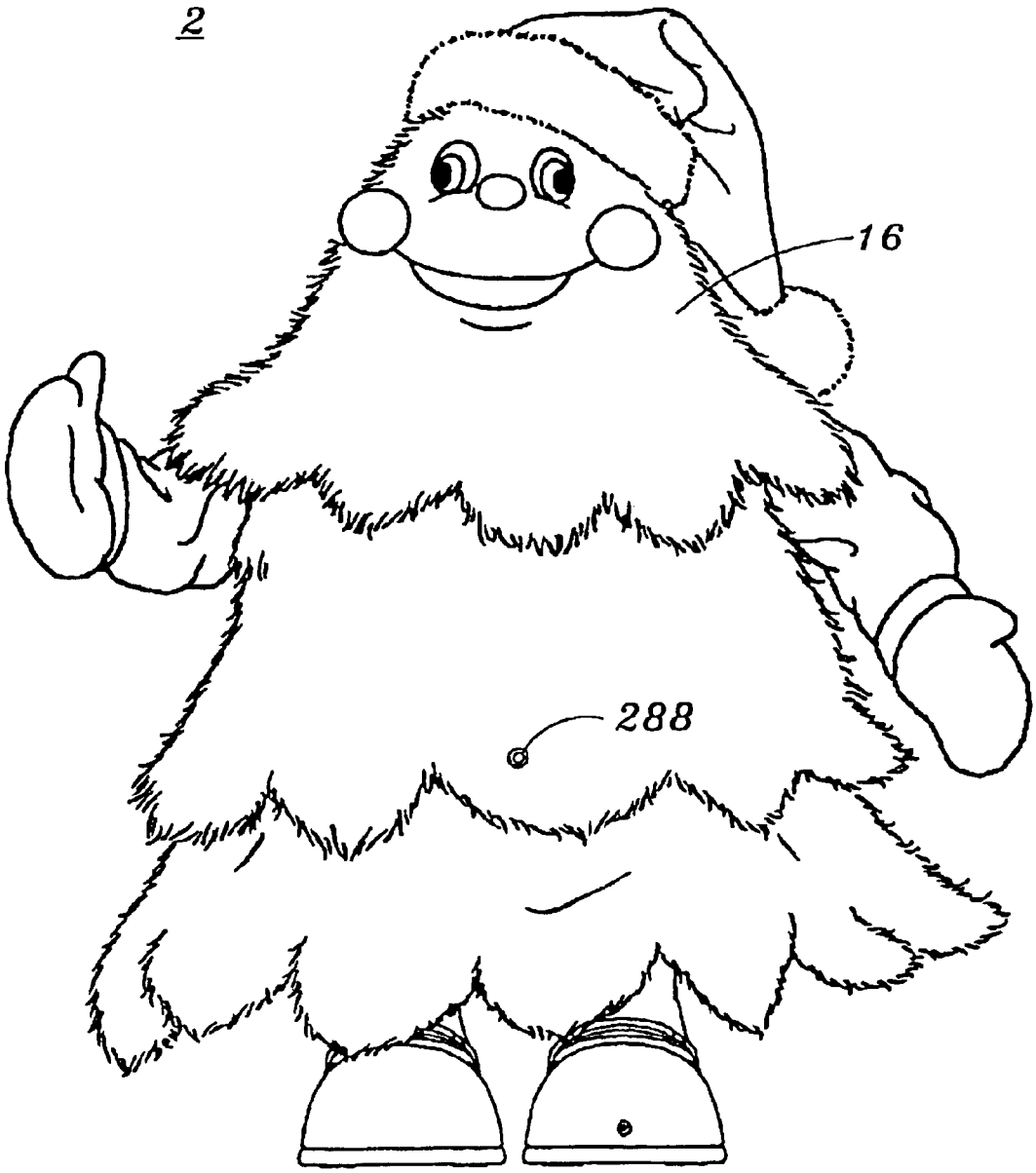
FIG. 10 is the second exemplary embodiment of the animation device with the Christmas tree exterior body.

FIGS. 9 and 10 depict an exemplary embodiment of the invention with a Christmas tree exterior body 16 attached thereto and integrated with animation device 2 (shown in hidden lines). As previously mentioned, the present invention may be utilized with a variety of different types of animated figures. For instance, the exterior body may represent an animal such as a dancing bear or gorilla. Or the exterior body may be in the form of a human being, such as a Sumo wrestler, dancing Luau lady, a large jolly man, or perhaps an animated cartoon character. As can be seen from the aforementioned suggestions, the animated figure may take the form of a wide variety of shapes, figures, or objects ranging from realistic depictions to make believe cartoon characters.

B. Description of Exemplary Embodiment of Upper Assembly

Figure 11:
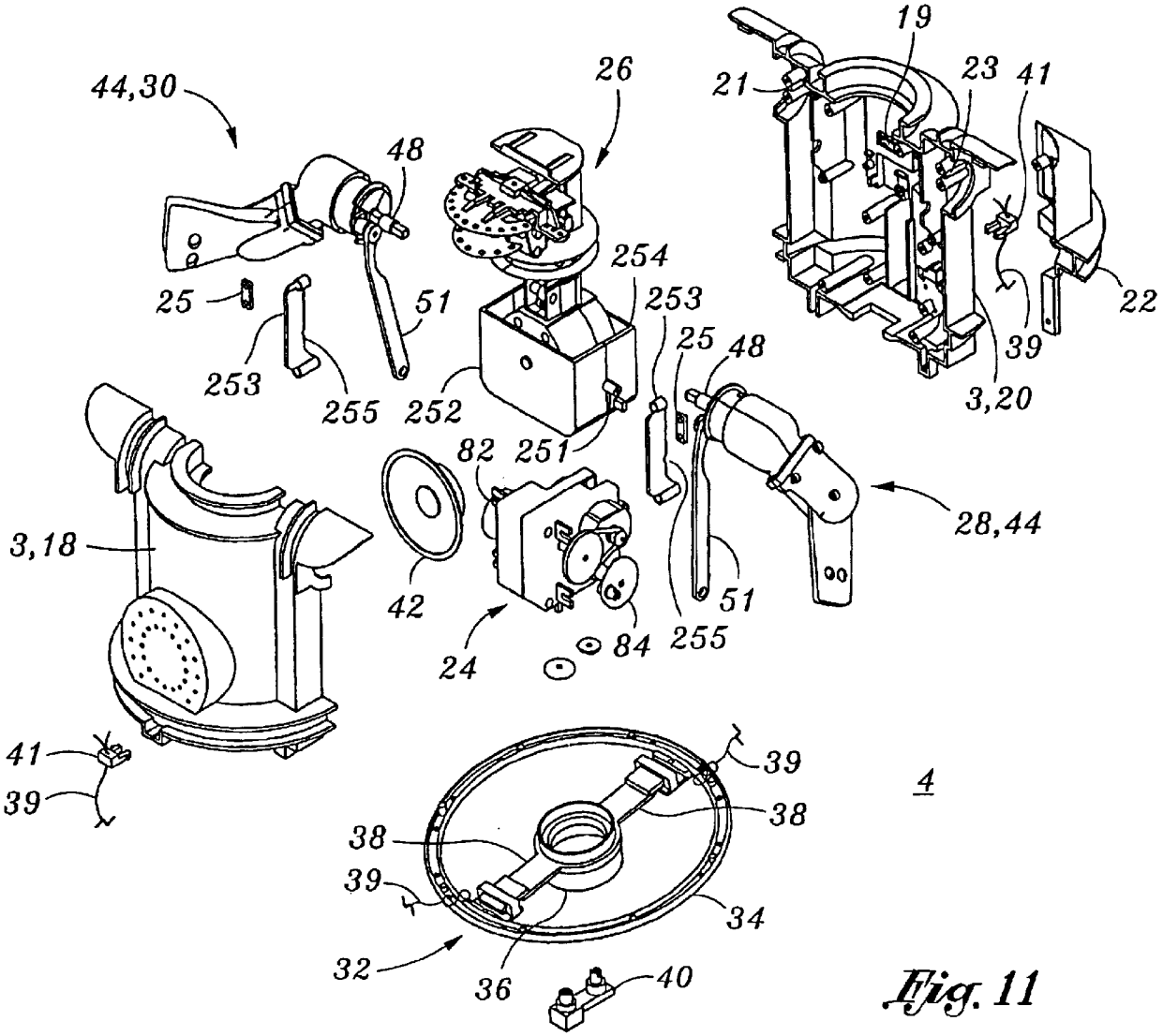
FIG. 11 is an exploded view of the upper assembly of the exemplary animation device from a front upper left side perspective.
Figure 12:
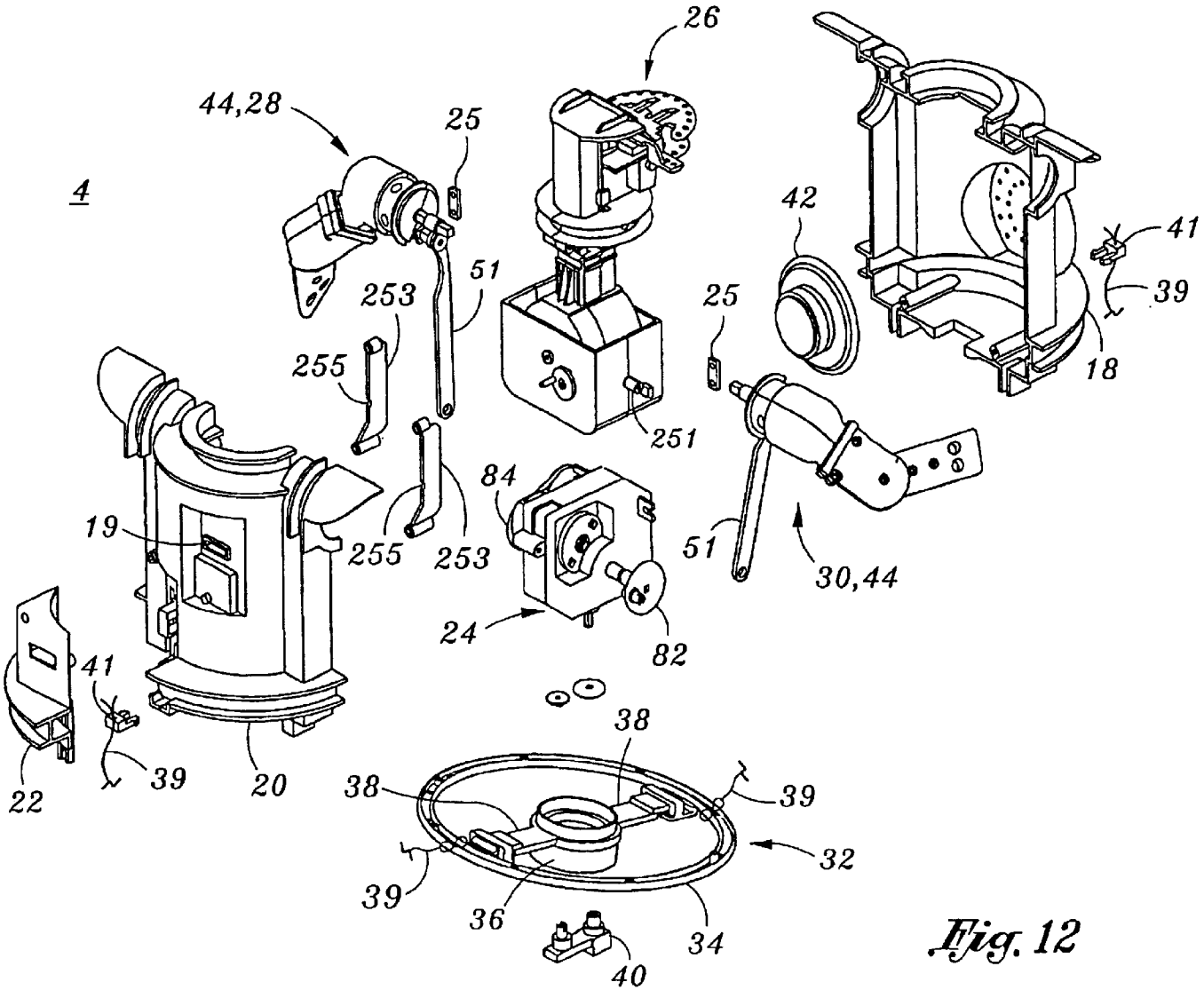
FIG. 12 is an exploded view of the upper assembly of the exemplary animation device from a rear upper right side perspective.

FIG. 11 is a front upper left side exploded view of upper assembly 4 of the exemplary animation device 2, and, FIG. 12 is a rear upper right side view of upper assembly 4. Upper assembly 4 is comprised of at least several main components: a main structural chassis 3, a lower drive unit 24, a left arm assembly 28 and right arm assembly 30, head and mouth animation device 26, and a midbody perimeter hoop 32. Upper assembly 4 is structurally held together by main structural chassis 3 having a clamshell type design. Chassis 3 includes two main components, front chest 18 and back chest 20 which may be secured together with a variety of known fastening techniques. Chassis 3 is adapted to enclose and support various internal components including head and mouth animation device 26, lower drive unit 24, and speaker 42. The head and mouth device 26 is rotatably fastened to chassis 3 with two vertical mounting brackets 253 which have swivel journals 255 that receive swivel bosses 251. Chassis 3 is also adapted to cooperatively engage with left and right arm assemblies 28, 30, and fully enclose arm movement input links 51. Also shown is midbody perimeter hoop 32 which includes spokes 38 and inner hub 36. Hoop movement cam 40 is utilized to induce motion into perimeter hoop 32, while hoop strings 39 are ties to outer frame 34 of the perimeter hoop 32 to constrain movement. It is also shown that hoop string 39 is tied to string fasteners 41 which snap fit into the bottom end of the front chest 18 and back chest 20. The function of perimeter hoop 32 will be elaborated in further detail later in the specification. Moreover, FIG. 12 clearly illustrates back chest cover 22, which attaches to back chest 20.

C. Description of Exemplary Embodiment of Lower Drive Unit

Figure 13B:
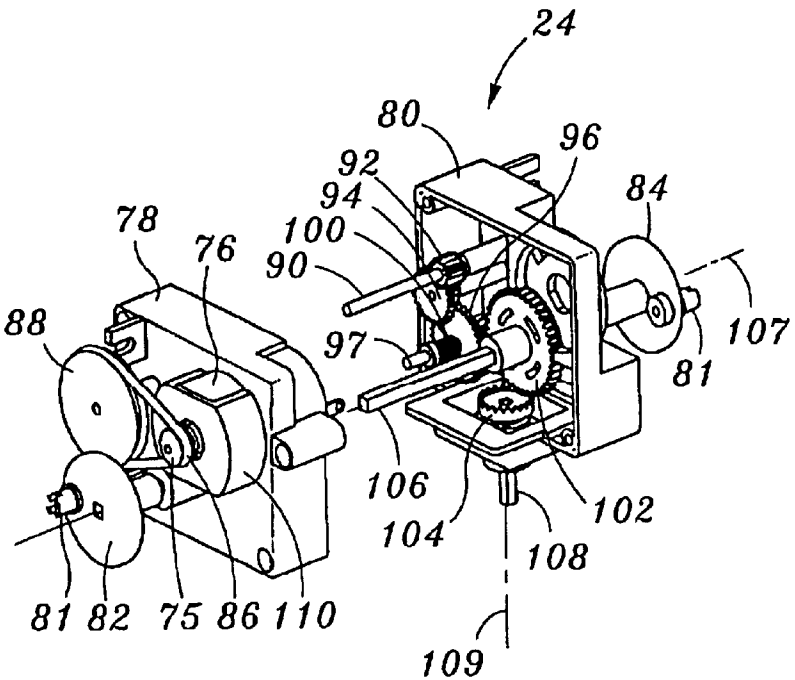
FIGS. 13A & 13B are exploded views of a lower drive unit.
Figure 13A:
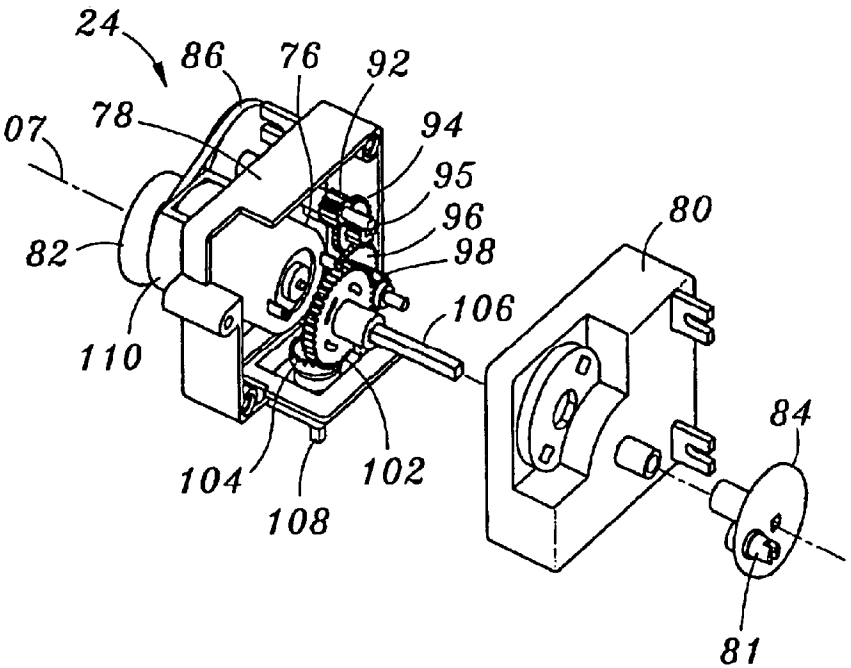

FIGS. 13A & 13B are exploded views of lower drive unit 24 which is used to produce motion in arm assemblies 28, 30, midbody perimeter hoop 32, and upper assembly 4. Lower drive unit 24 has a drive unit base 78 and a drive unit cover 80, which when fastened together, have a clamshell design forming an enclosure for lower drive unit 24 components. Both base 78 and cover 80 are adapted to be fastened to front and back chest 18, 20. Base 76 provides a cylindrical receiving bracket 110 for a first reversible electric motor 76. Lower drive unit 24 is configured to produce rotation about a first axle 106 positioned along a first axis 107, while simultaneously producing rotation about a second axle 108 positioned along a second axis 109, where the first and second axes 107, 109 are oriented substantially normal with respect to one another.

This configuration is accomplished by coupling first electric motor 76, having a first motor pulley 75, to a first drive pulley 80 via a first drive belt 86. First drive pulley 80 is coupled to one end of a pulley axle 90. A first pinion gear 92 is axially coupled to an opposing end region of pulley axle 90 and the other end of pulley axle 90 is rotatably disposed within a retaining boss. First pinion gear 92 is arranged to intermesh with and drive a first spur gear 94 which intermeshes with and drives a second pinion gear 95 axially coupled contiguous to first spur gear 94. Second pinion gear 95 is arranged to intermesh with and drive a second spur gear 96 which is fit to a second spur gear shaft 97 via a spur/pinion gear clutch 100. Furthermore, second spur gear 96 is axially coupled contiguous to a third pinion gear 98 and also subject to spur/pinion gear clutch 100. Third pinion gear 98 meshes with and drives a first axle drive spur gear 102 coupled to a first axle 106. First axle 106 is disposed within axle journals on both base 78 and cover 80 so as to position first axle 106 about a substantially horizontally first axis 107.

Mounted on opposing ends of first axle 106 is a left cam 82 and right cam 84, which when driven by first electric motor 76, produce simultaneous radial motion about first axle 106. As observed from FIGS. 13A & 13B, left and right cams 82, 84 are configured external to drive unit 24. Disposed on the exterior faces of left and right cams 82, 84 are cam linkage connectors 81 which are adapted to rotatably cooperate with arm movement links 51 (see FIGS. 11 & 12). Also note that left cam 82 cam linkage connector 81 is preferably not aligned with right cam linkage connector 81. The function of left and right cams 82, 84 is to drive left and right arm assemblies 28, 30, details of which will be discussed in further detail later in the specification. Furthermore, to produce body movement in upper assembly 4, a second axle drive gear 104 is provided on an end of a second axle 108 oriented about a second axis 109 which is configured substantially perpendicular to first axle 106. Second axle drive gear 104 is configured to be normally oriented to first axle drive gear 102 so that it intermeshes with and is driven by first axle drive gear 102. When second axle drive gear 104 is driven by first electric motor 76, second axle 108 is rotated about the second axis 109. Second axle 108 is coupled to lower body parts of animation device 2 to produce movement thereof, effects of which will be elaborated in later in the specification.

D. Description of Exemplary Embodiment of Arm Assemblies

Figure 14B:
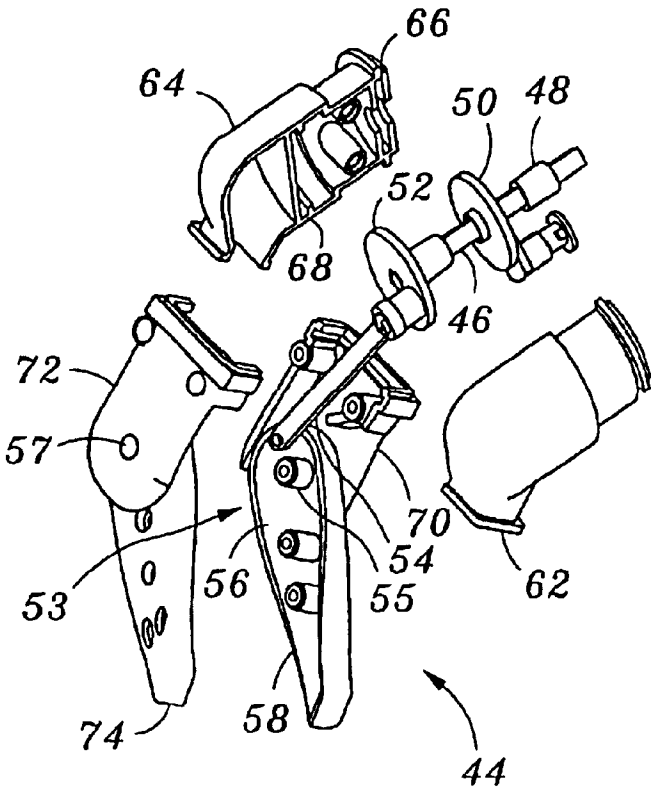
FIGS. 14A & 14B are exploded views of an arm assembly of the exemplary animation device.
Figure 14A:
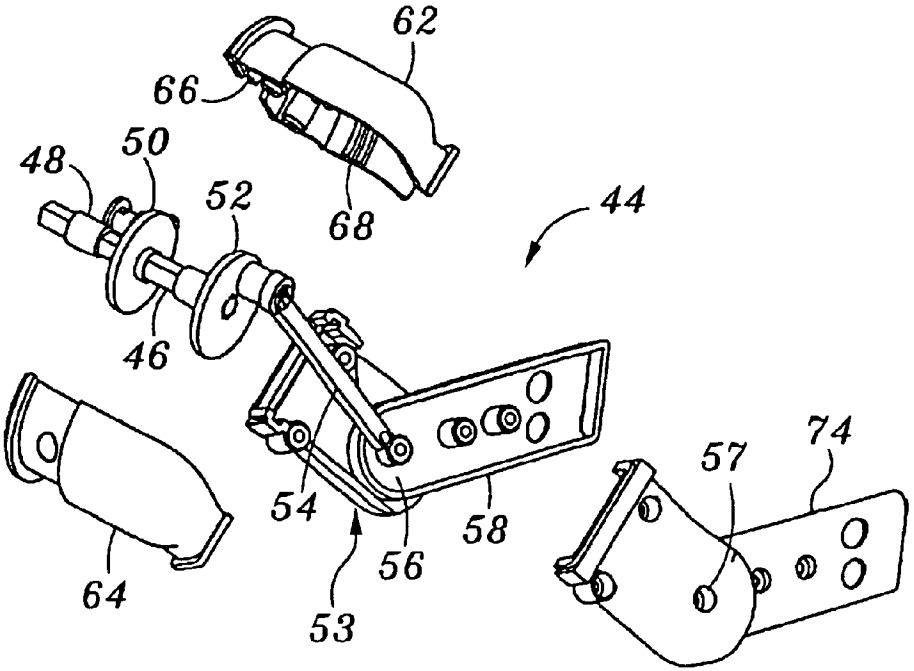

FIGS. 14A & 14B are exploded views of an arm assembly 44 of the exemplary animation device 2. Motion is induced into arm assembly 44 from lower drive unit 24, via rotation of left cam and right cams 82, 84, which in turn generate rotational movement of arm movement links 51 which are cooperatively hinged to input cam 50, so that input cam 50 is rotatably driven. Input cam 50 is axially centered and coupled to a center section of shoulder axle 46 which is rotatably fixed to one of the left or right shoulder journals 21, 23 integrally formed within back chest 20 (shown in FIG. 11). Axle 46 is retained in left and right shoulder bearings 21, 23, jounal caps 25 (shown in FIG. 11), and by an inboard retaining boss 48 fixed to the inboard distal end of axle 46. Therefore, shoulder bearings 21, 23 act as a fixed hard mount for shoulder axle 46, yet still allowing axle 46 to rotate. Coupled to an exterior distal end of shoulder axle 46 is output cam 52, which is swivel linked to arm link 54 to transfer rotational movement. Arm link 54 is swivel connected to forearm cam 56 which is integrally molded with forearm follower 58. Forearm follower 58 acts as a movable exterior structural portion of arm assembly 44. An embodiment of animation device 2 has a hand piece (not shown) attached to the distal tip of forearm follower.

The exterior of arm assembly 44 is formed by utilizing a front shoulder clam shell 62 connected to a rear shoulder clam shell 64. Interiorly molder within front and rear shoulder clam shells 62, 64 are input cam journals 66 and output cam journals 68 which are adapted to receive input cam 50 and output cam 52, respectively, and configured to allow cams 50, 52 to freely rotate. From FIGS. 14A and 14B it is further shown that inner clam shell 70 and outer clam shell 72 are fastened together to form an outer exterior portion of arm assembly 44 which encloses arm link 54 and forearm cam 56. A forearm follower cover 74 is attached to forearm follower 58. The combination of inner and outer arm clamshell 70, 72, forearm cam 56, forearm follower 58, and forearm follower cover 74 provide the structure which defines a swivel elbow joint 53. The joint rotates about an axis which is centered through inner elbow boss 55 and an inner elbow boss receiver (not shown) integrally formed with follower cover 74. The swivel elbow joint 53 is fastened together axially through elbow joint apertures 57 integrally formed within both arm clamshells 70, 72.

E. Description of Exemplary Embodiment of Lower Assembly

Figure 15:
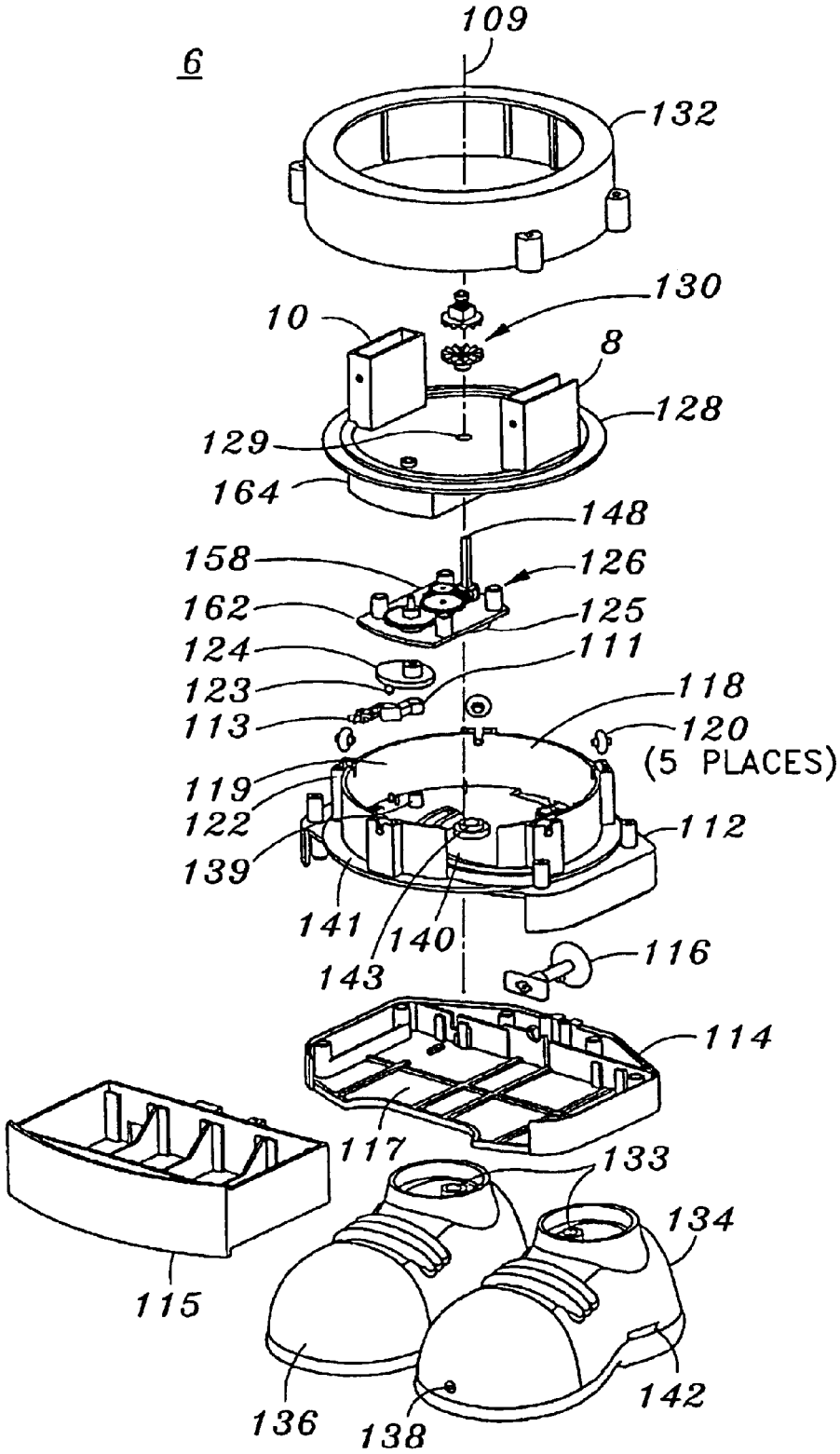
FIG. 15 is an exploded view of the lower assembly of the exemplary embodiment of the animation device from an upper front left side perspective.
Figure 16:
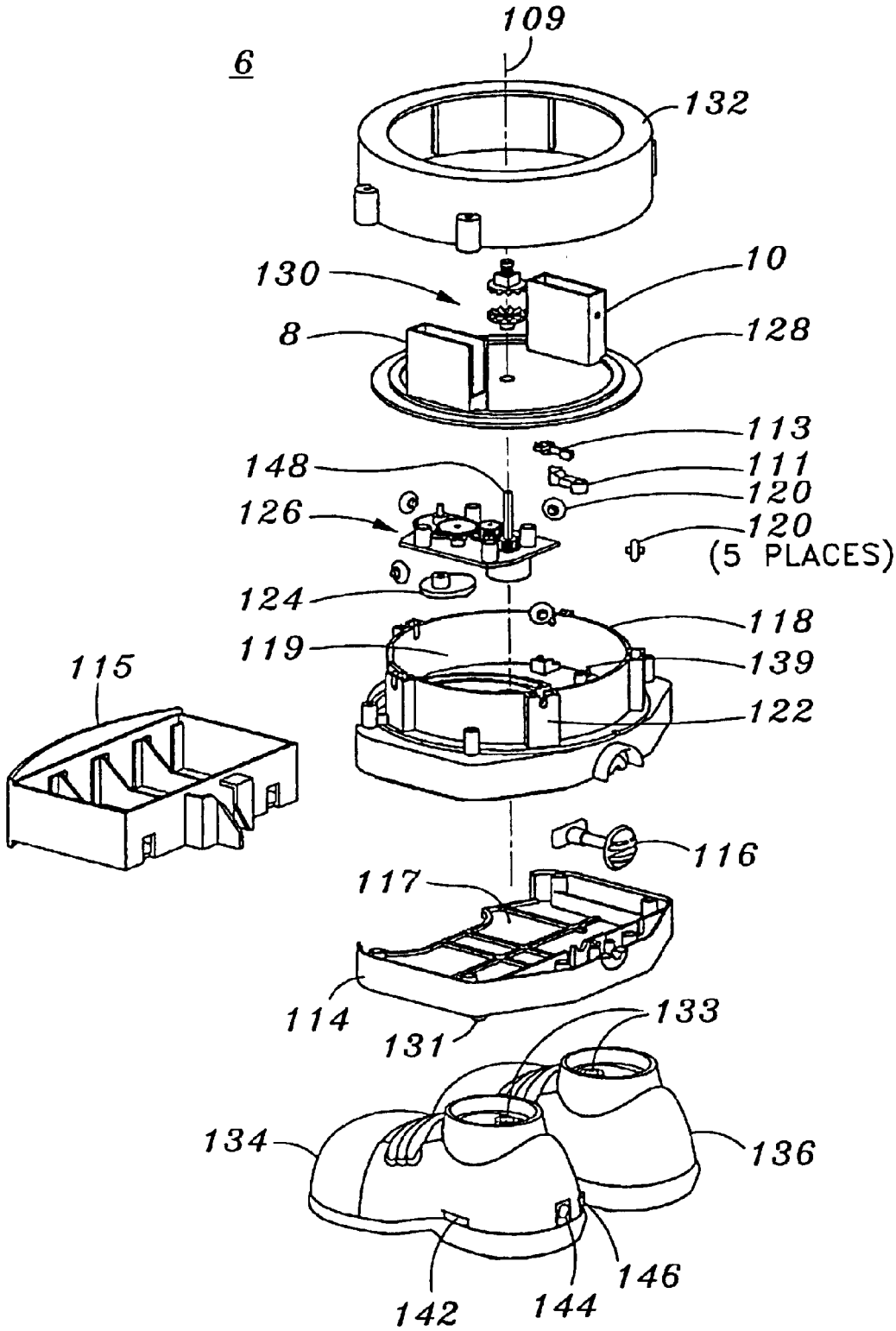
FIG. 16 is another exploded view of the lower assembly of the exemplary embodiment of the animation device from an upper rear left side perspective.

FIG. 15 is an exploded view of lower assembly 6 of the exemplary embodiment of animation device 2 from an front upper left side perspective, and FIG. 16 is another exploded view of lower assembly 6 of the exemplary embodiment of animation device 2 from an rear upper left side perspective. Left and right shoes 134, 136 are adapted to support animation device 2 on a substantially horizontal surface. Left shoe 134 includes motion detector 138, power on/off and volume control 142, electrical cord receptacle 144, and mode selection switch 146, the function of these components will be described later in the specification. Lower housing 114 is fastened to shoes 134, 136 by inserting at least one fastening dowel 131 (see FIG. 16, limited view) into shoe fastening bosses 133. Upper housing 112 is fastened to lower housing 114 to form an enclosure 117 for a battery case 115. Battery case 115 may be installed and removed from enclosure 117 by securing enclosure 117 opened/closed with release fastener 116.

Besides providing an enclosure for battery case 115, upper housing 112 has other features which are herein next described. A collar 18 is connected to the top surface of planar base 141 wherein the top surface acts as the a top for enclosure 117. Integrally molded into planar base 141 is arcuate shaped lower cam receiving slot 140 which receives lower cam 124. Also, integrally molded to the exterior surface of collar 18 are a plurality of waist roller receivers 122 which are each adapted to receive a waste roller 120. As further shown in FIGS. 15 & 16, a revolving plate 128 is adapted to sit on top of the plurality of rollers forming a second enclosure 119 of which a gear train 126, gear train box 164, and gear train cover 162 are located. Further description of gear train 126 will be provided in the following section. It is noted that gear train cover 162 has attached to its underside a central cylindrical mount 125 centered about second axis 109 for the purpose of aligning a third axle 148 of gear train 126 with second axis 109 defined by axle 108 (see FIGS. 13A & 13B) and for pivotably/rotatably attaching gear train 126 to a central receiving boss 143 integrally formed to the top surface of planar base 141, and centered about second axis 109. When rotational movement is imparted on third axle 148, which is actually just an extension of second axle 108 separated by a clutch release mechanism 130, lower cam 124 is rotated by fourth axle 158 (see FIG. 17). The lower cam retainment boss 123 tracks the arcuate shaped lower cam receiving slot 140, and as a result, a rotational movement about second axis 109 is induced into revolving plate 128 since upper housing 112 is rigidly mounted to left and right shoes 134, 136 which are not intended to move. Furthermore, since upper assembly 4 is rigidly mounted to revolving plate 128, upper assembly 4 will also rotate in unison with revolving plate 4 when third axle 148 is driven by first electric motor 76.

Figure 17A:
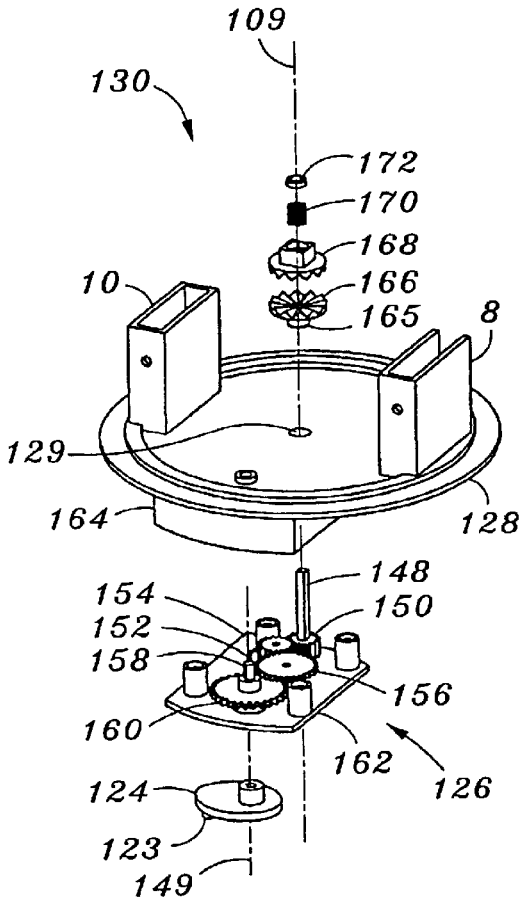
FIG. 17A is a close-up exploded view of the gear train, revolving plate and clutch release mechanism.
Figure 17B:
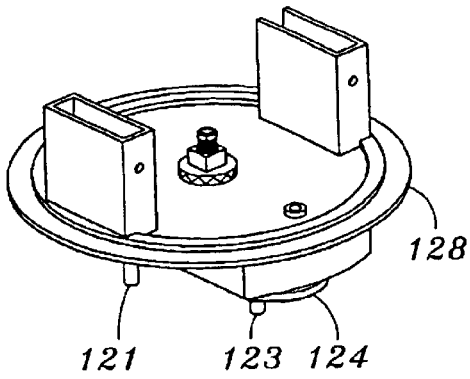
FIG. 17B shows the same assembled.

Also shown in FIGS. 15–17 is a waist positioning feature which allows animation device 2 to detect the amount of rotation that revolving plate 128 and upper assembly 4 undergoes about second axis 109. As shown in FIGS. 15 and 16, a waist movement cam receiving boss 139 is integrally formed on the top surface of planar base 141. Waist movement actuation lever 111 is rotatably attached to the waist movement cam receiving boss 139. Also attached to the planar base 141 proximate to lever 111 is a waist movement switch 113. Lever 111 is adapted to be depressed by actuation rod 121 which projects downwardly from revolving plate 128. When rod 121 contacts lever 111, switch 113 is closed and a signal is sent to central processing unit 284, which in turn, utilizes the positioning data to control motion routines.

FIG. 17 is a close-up exploded view of lower cam 124, gear train assembly 126, revolving plate 128 and clutch release mechanism 130. Gear train assembly 126 includes third axle 148 which is aligned along second axis 109, wherein the second axis 109 is oriented perpendicular to gear train cover 162. Third axle 148 has an upper end which is received through plate center axial receiving bore 129 of revolving plate 128. The lower end of third axle 148 projects through an aperture gear train cover 162 such that the end may be connected to lower cam 124. A fourth pinion gear 150 is coupled to third axle 148 proximate just above gear train cover 162 about second axis 109. Fourth pinion gear 150 intermeshes with and drives third spur gear 152. Axially coupled and contiguous to third spur gear 152 is a fifth pinion gear 154 located above third spur gear 152 which intermeshes with and drives a fourth spur gear 156. Axially coupled to and contiguous to fourth spur gear 156 is a sixth pinion gear (not shown) below fourth spur gear 156. Sixth pinion gear intermeshes with and drives third drive gear 160 which is coupled to a fourth axle 158. Fourth axle 158 is oriented along a third axis 149 which is that offset from and parallel to the second axis 109. Fourth axle 158 is then connected to lower cam 124 which produces radial motion about the third axis.

FIG. 17 also illustrates clutch release mechanism 130 which includes engagement spring 170 and engagement ring 172 which act to maintain pressure on upper clutch coupler 168 so that it stays engaged with lower clutch coupler 166. It is noted that clutch coupler 168 receives the lower end of second axle 108 (see FIGS. 13A & 13B) which is oriented along second axis 109. A lower clutch receiving boss 165 on lower clutch coupler 166 is received through plate center axial receiving bore 129 of revolving plate 128. Receiving boss 165 on lower clutch coupler 166 is fit to the upper end of third axle 148. As a result, an axial drive line is established between second axle 108 and third axle 148, both of which are centered about and rotate about the second axis 109. The function of clutch release mechanism 130 is provided to ensure that damage does not result to lower drive unit 24 gears or gear train assembly 126 gears, or any other drive train components of animation device 2. In particular, clutch release mechanism 130 releases lower drive unit 24 from being bound to gear train assembly 126 when arm assemblies 28, 30, or body portions of lower assembly are inadvertently (or perhaps even purposely) moved by one handling animation device 2

Figure 18B:
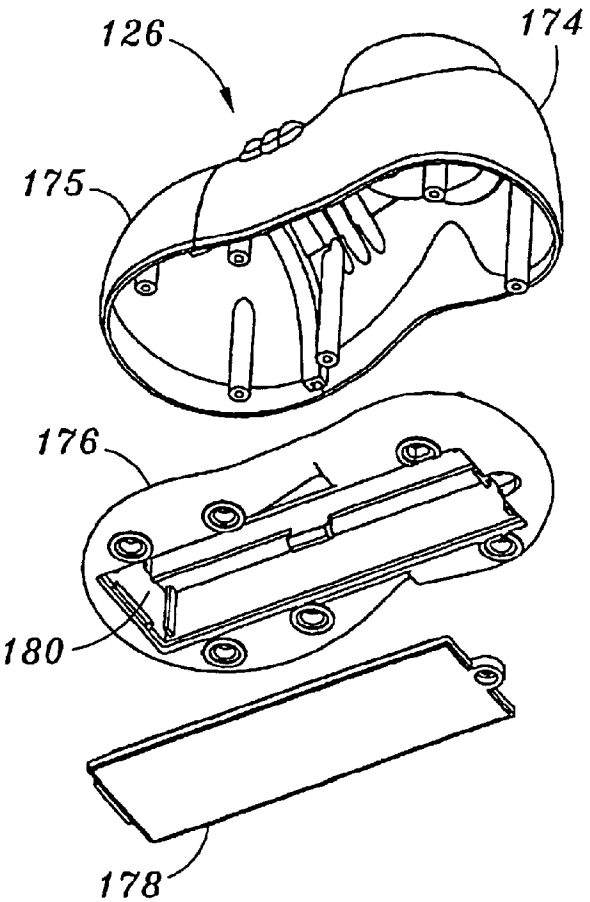
FIGS. 18A & 18B are exploded views of the right foot of the exemplary embodiment of the animation device from an upper and lower perspective view.
Figure 18A:
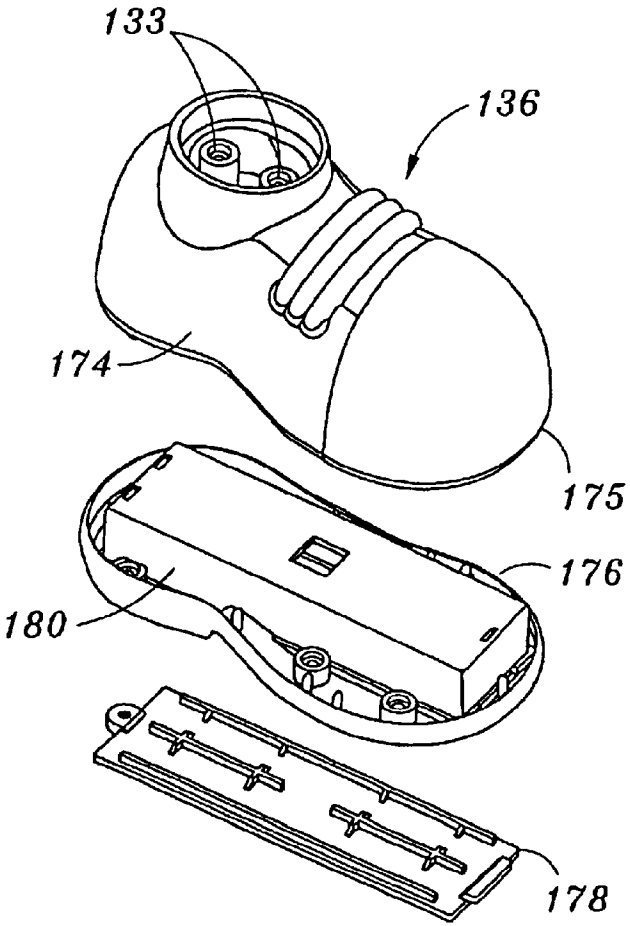

FIGS. 18A & 18B are exploded views of a right foot 136 of the exemplary embodiment of the animation device 2. Right shoe 136 includes upper right shoe body 174, upper right shoe toe 175, and right shoe sole 176. Battery enclosure 180 is integrally formed within right shoe sole 176 and covered by removable battery door 178. Upper right shoe body 174 may be disposed with at least one shoe fastening boss 133 which accepts mounting dowel 131 (see FIG. 16) which is attached to the bottom of lower housing 114.

Figure 19B:
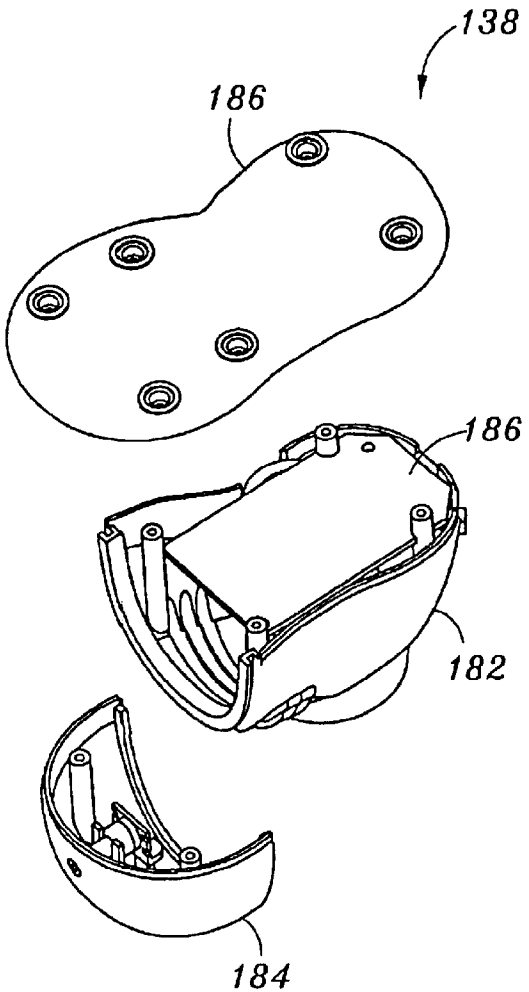
FIGS. 19A & 19B are exploded views of the right foot of the exemplary embodiment of the animation device from an upper and lower perspective view.
Figure 19A:
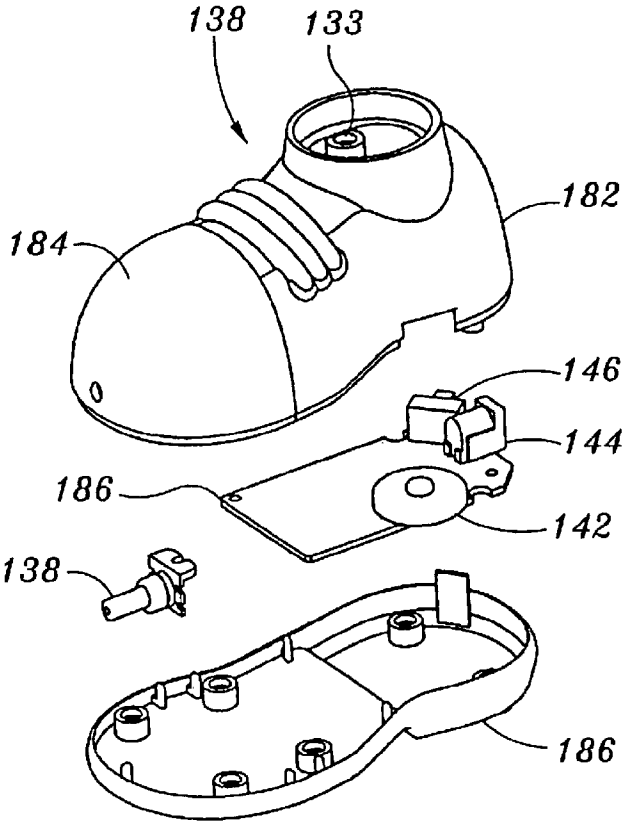

FIGS. 19A & 19B are exploded views of a left foot 138 of the exemplary embodiment of the animation device 2. Left shoe 138 includes upper left shoe body 182, upper left shoe toe 184, and left shoe sole 186. Printed circuit board 186, of which power on/off and volume control 142, mode selection switch 146, and electrical cord receptacle 144 are attached, is adapted to be integrated within and attached to left foot 138. Also, note motion detector 138 is mounted in upper left show toe 184. Upper left shoe body 174 may be disposed with at least one shoe fastening boss 133 which accepts a mounting dowel 131 (see FIG. 16) which is attached to the bottom of lower housing 114.

F. Description of Exemplary Embodiment of Head and Mouth Animation Device

The following section of the specification discusses head and mouth animation device 26, which is utilized in the exemplary embodiment of the animation device. A similar embodiment of the head and mouth animation device 26 has been disclosed and discussed in U.S. application Ser. No. 10/127,241, filed on Apr. 22, 2002, entitled "Animation Device for Head and Mouth of a Toy", the content of which is expressly incorporated by reference herein in its entirety.

Figure 24A:
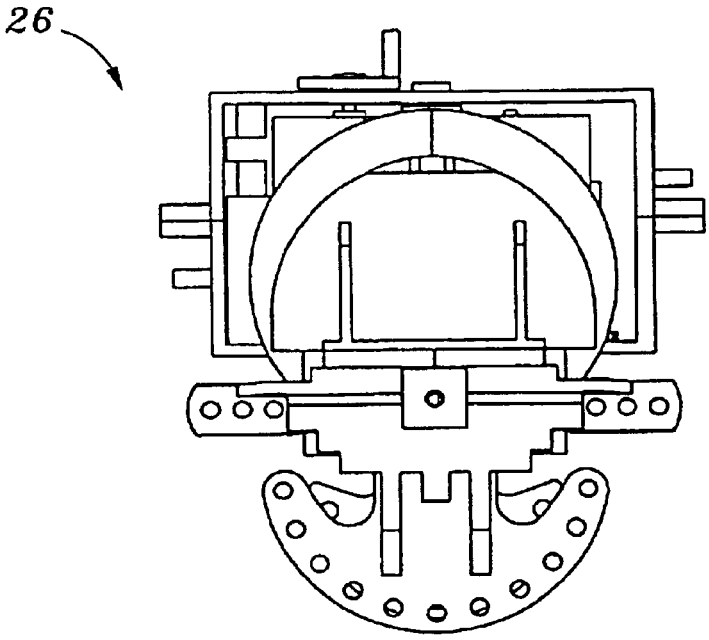
FIGS. 24A & 24B is right side view of the head and mouth device utilized in the exemplary embodiment of the animation device.
Figure 24B:
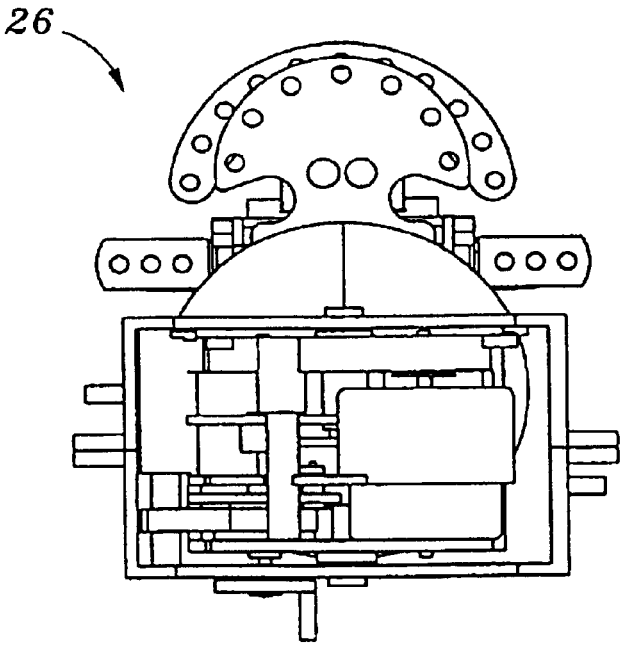
Figure 26:
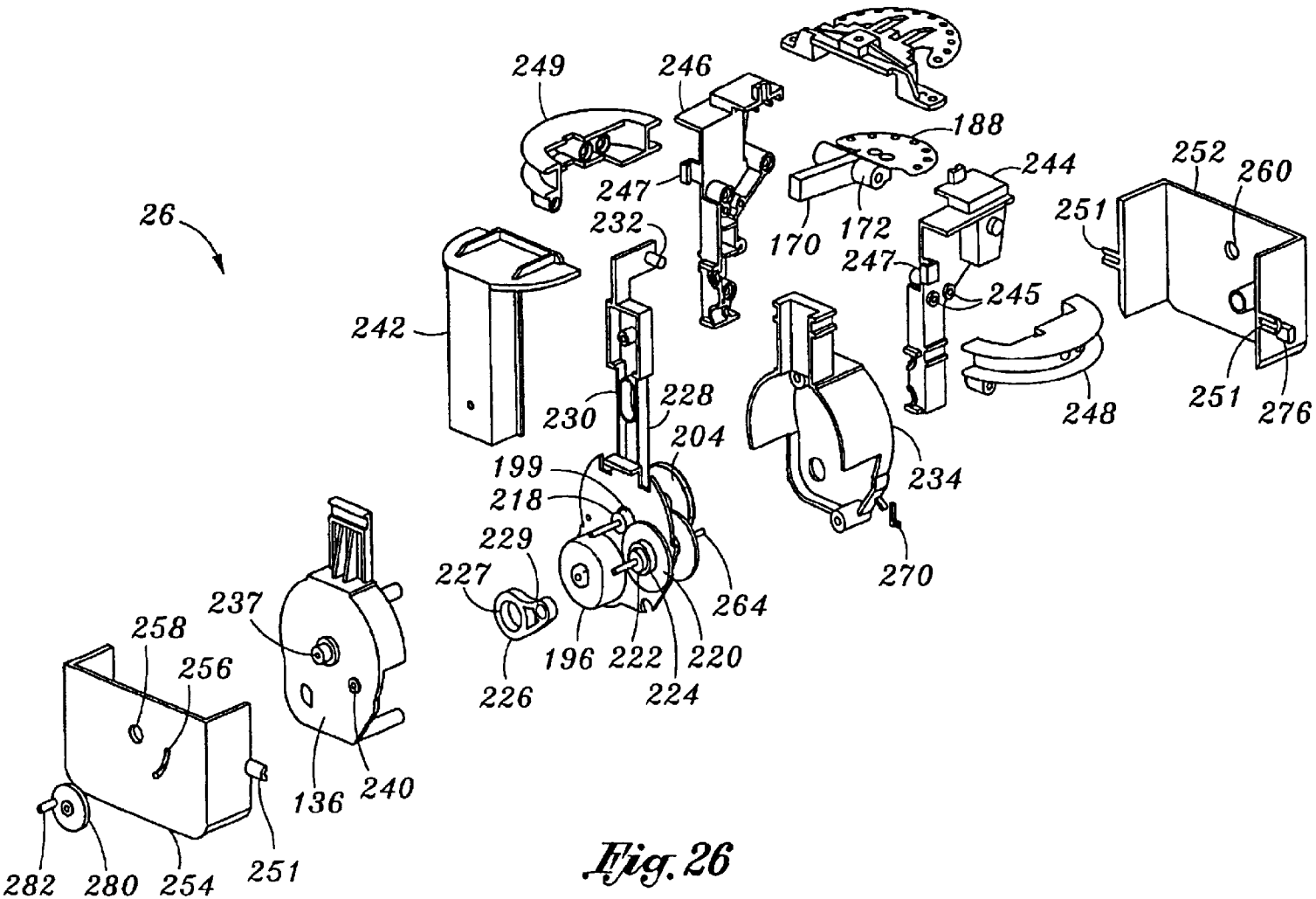
FIG. 26 is an exploded view of the head and mouth animation device from a back upper right side perspective.
Figure 27:
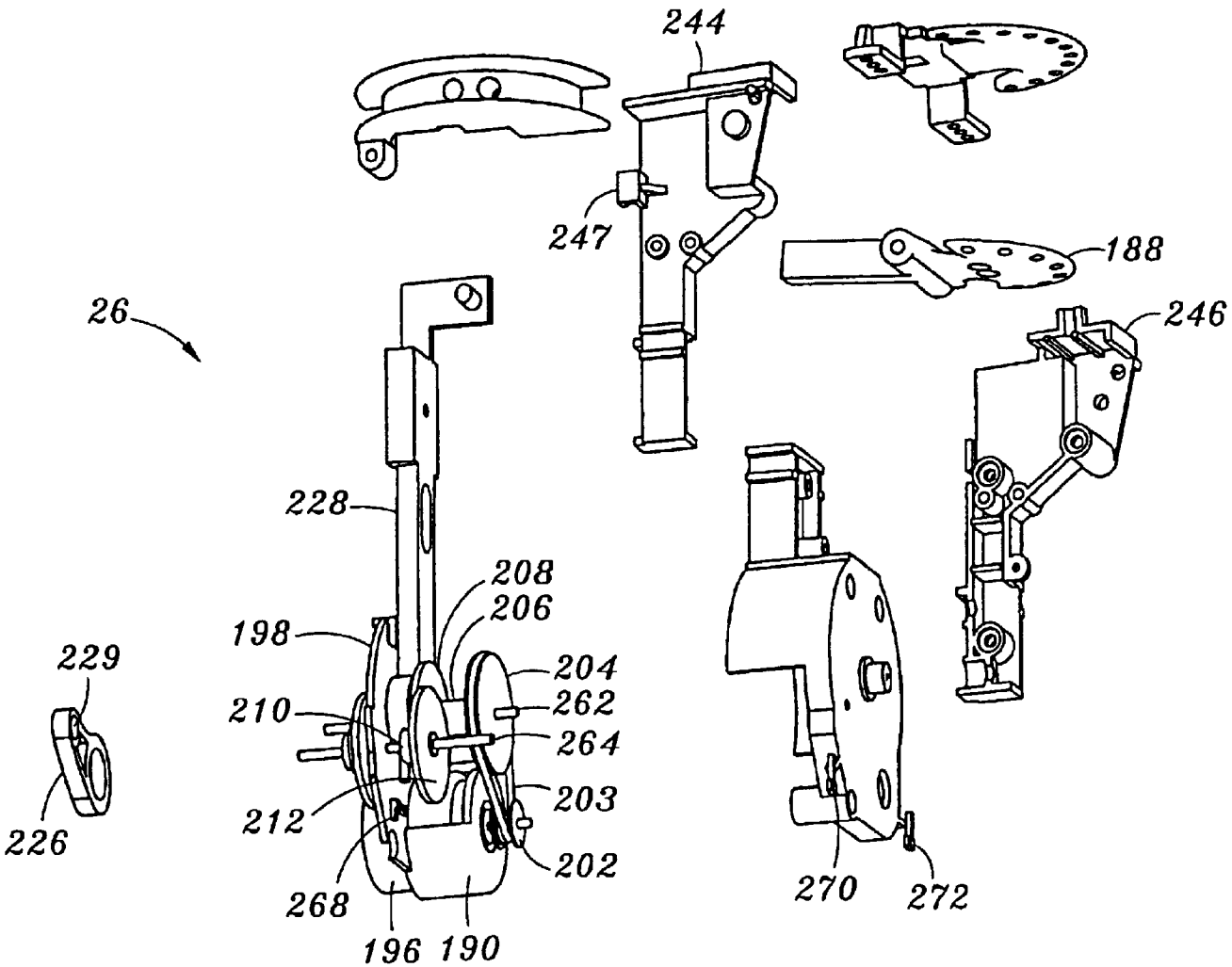
FIG. 27 is an exploded view of the head and mouth animation device from a lower front lower right side perspective.
Figure 28:
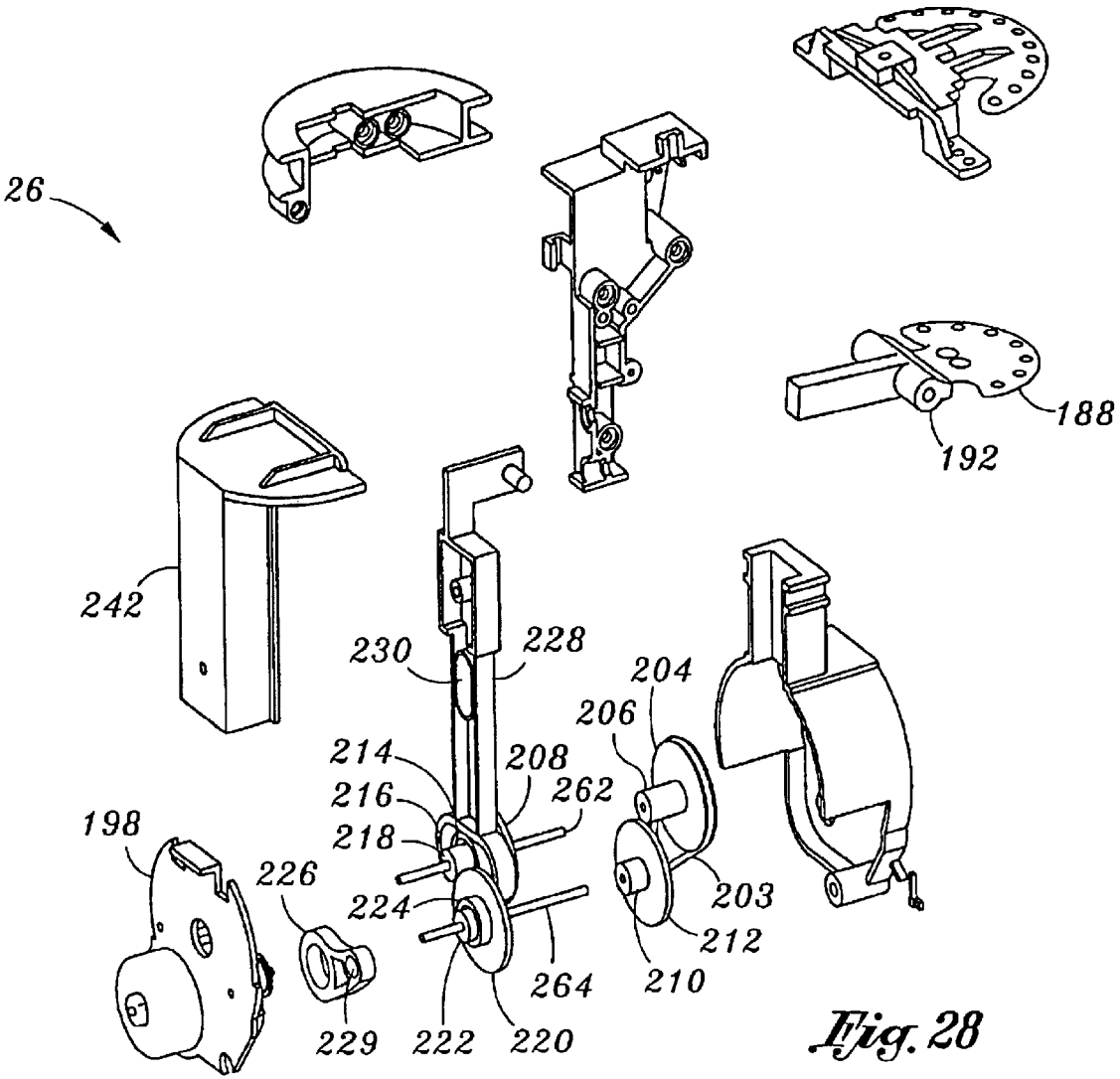
FIG. 28 is an exploded view of the head and mouth animation device from a back upper right side perspective.
Figure 29:
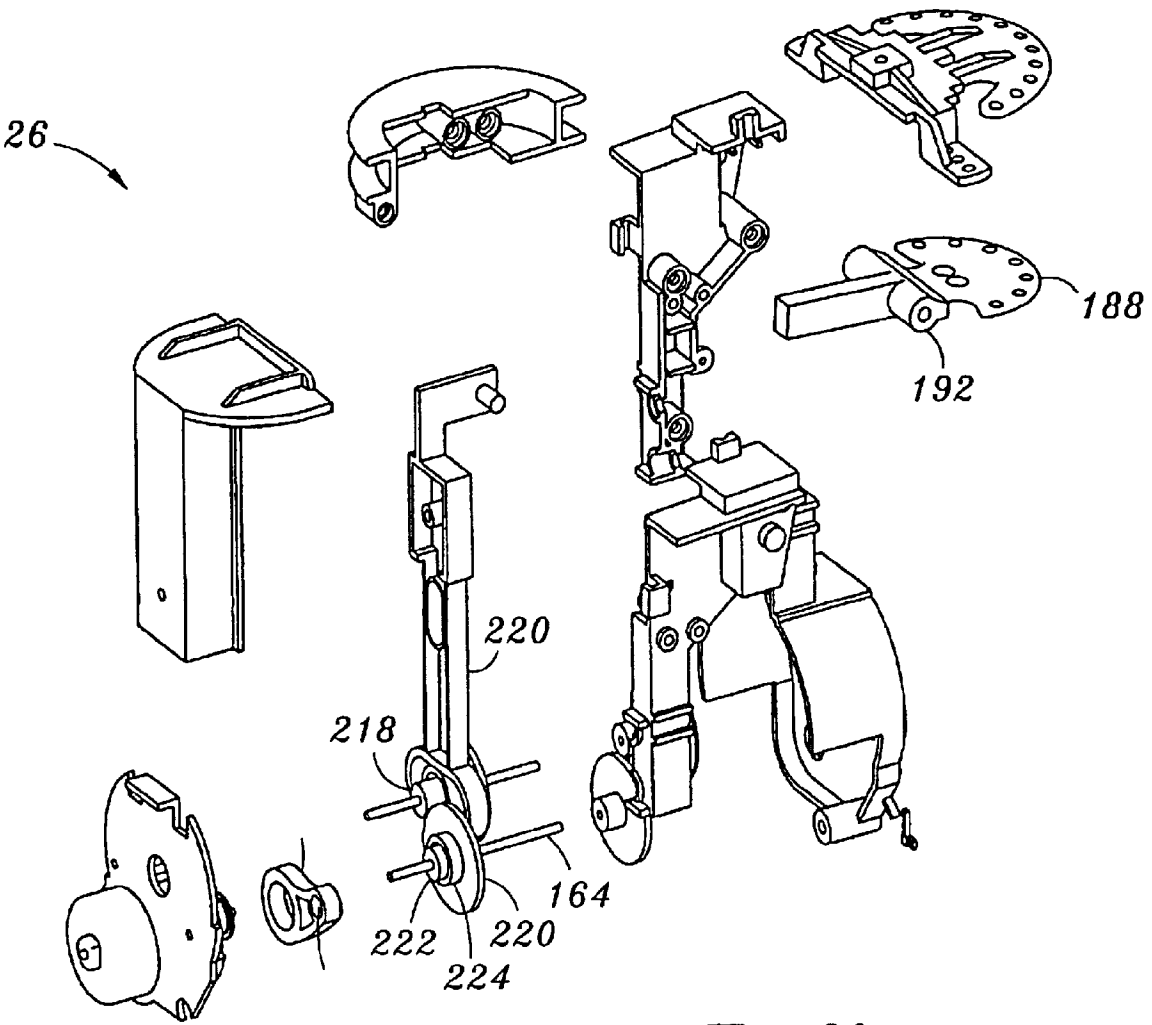
FIG. 29 is another exploded view of the head and mouth animation device from an upper back right side perspective.

FIGS. 20–23 illustrate a front view, rear view, right side view, and left side view of the head and mouth animation device 26 utilized in the exemplary embodiment of the animation device 2. Further provided are FIGS. 24A & 24B are provided which are top and bottom views of head and mouth animation device 26. Moreover, numerous exploded views of animation device 26 are provided including FIG. 25 which is a front upper right side perspective; FIG. 26 being an upper back right side perspective; FIG. 27 being a front lower right side perspective; FIG. 28 being an upper back right side perspective; FIG. 29 which is a back upper right side perspective; and FIG. 30 being a back upper left side perspective view. The exemplary embodiment of head and mouth animation device 26, shown in the aforementioned FIGS. 20–30, includes several main components, each of which will be described in detail below.

As shown in FIGS. 25–30, head and mouth animation device 26 includes a second reversible electric motor 196 attached to a motor mount plate 198 via a second cylindrical receiving bracket 198. Disposed in an approximate center of motor mount plate 198 is a circularly configured opening 199. Also disposed within the motor mount plate 198 is a pin aperture 201. The use of the opening 199 and pin aperture 201 will be discussed later in the specification. A second motor pulley 202 is coupled to the drive shaft of second reversible electric motor 196. Second motor pulley 202 is rotatably coupled to a second drive pulley 204 via a second drive belt 203 extending therebetween wherein.

Contiguously attached to and extending axially from second motor pulley 202 is a sixth pinion gear 206. The second motor pulley 202 and sixth pinion gear 206 collectively define an axially extending central aperture which slidably accommodates an elongate, cylindrically configured first pin 262 which is advanced into and through such central aperture. It is further noted that since both second motor pulley 202 and sixth pinion gear 206 are contiguously coupled together, they rotate in unison as one unit, however, they are still able to freely spin as one unit about first pin 262.

Next, it is noted that sixth pinion gear 206 is intermeshed and drives a fifth spur gear 212. Contiguously attached to and extending axially from fifth spur gear 212 is a seventh pinion gear 210. As a result of fifth spur gear 212 and seventh pinion gear 210 being coupled together, they collectively define a continuous aperture extending axially therethrough. This aperture has a circular cross-sectional configuration, and is sized to slidably accommodate an elongate second pin 264 which is also slidably advanced through bracket pin aperture 201 of the motor plate 198, with bracket pin aperture 201 having a diameter which closely exceeds the diagonal width of the second pin 264, thus allowing second pin 264 to be rotatable therein. It is further noted that since both fifth spur gear 212 and seventh pinion gear 210 are contiguously coupled together, they rotate in unison as one unit, however, they are still able to freely spin as one unit about second pin 262.

Furthermore, seventh pinion gear 210 is intermeshed with and drives a sixth spur gear 208, which like the second drive pulley 204 and six pinion gear 206, is rotatably mounted to first pin 262. Contiguously attached to and extending axially from the side sixth spur gear 208 is an inner cam 214 and an eighth pinion gear 218. Eighth pinion gear 218 is rotatably coupled to first pin 262 which extends through circular configured opening 199 within the motor mount plate 198 (see FIG. 26). Thus, is noted that eighth pinion gear 218 is advanced through circular configured opening 199 within the motor mount plate 198. It is further noted that since sixth spur gear 208 and eighth pinion gear 218 are contiguously coupled together, they rotate in unison as one unit, however, they are still able to freely spin as one unit about second pin 262.

Figure 30:
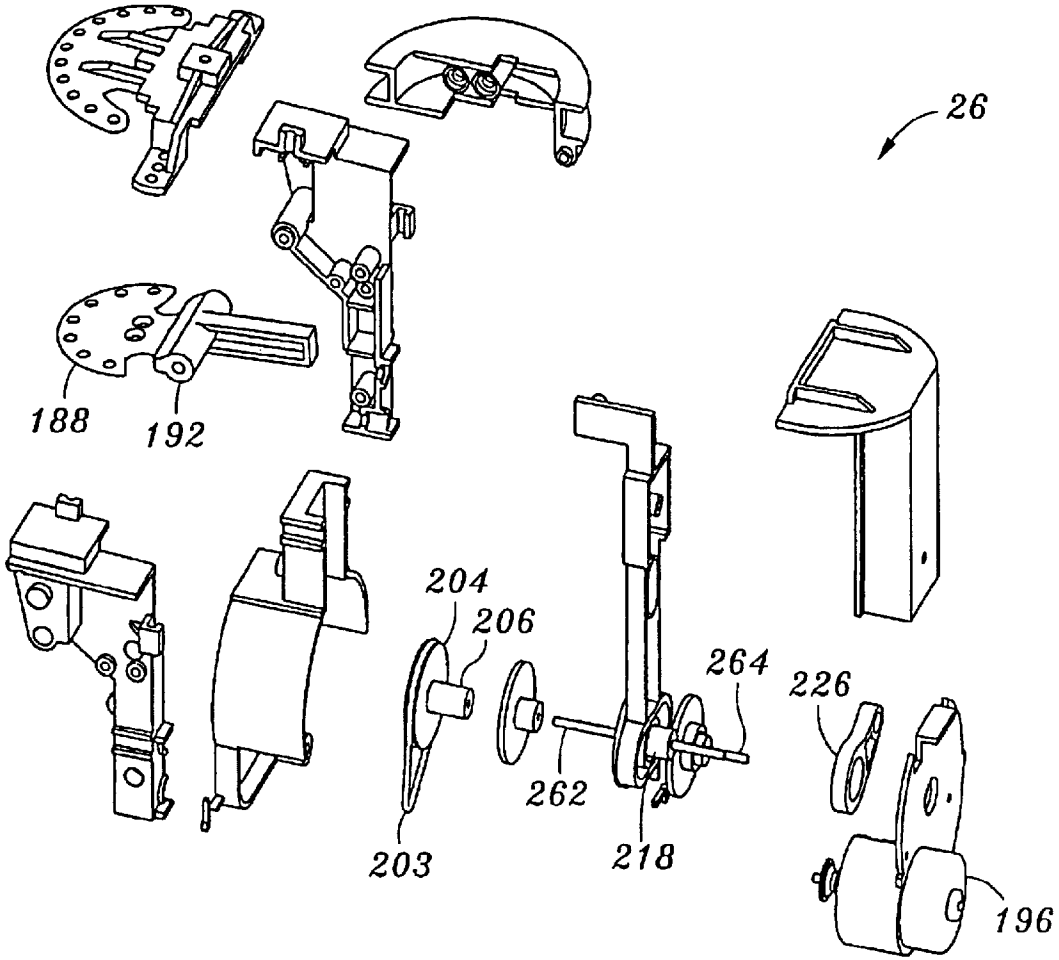
FIG. 30 is an exploded view of the head and mouth animation device from an upper back left side perspective.

Furthermore, as best seen in FIGS. 28–30, also contiguously attached to the side of the six spur gear 208 is inner cam 214 which has eighth pinion gear 218 positioned within, however, not concentrically about the axis defined by first pin 262. Rather, it is noted that inner cam 214 is radially offset from the axis defined by first pin 262. As a result, the center axis of cam 214 is also offset from the center axis of eighth pinion gear 218 which is also defined by first pin 264.

Next, it can be seen that inner cam follower 228 is positioned between six spur gear 208 and the motor mount plate 198 (see FIG. 27) such that inner cam 214 is advanced into and slidably movable within inner cam receiving slot 216 which is attached to the lower end of cam follower 228, the function of which will be detailed later in the specification.

In regard to functionality, the activation of second electric motor 196 facilitates rotation in second drive pulley 204, which in turn facilitates rotation of sixth pinion gear 206, and which in turn facilitates concurrent rotation of fifth spur gear 212. The rotation of fifth spur gear 212 facilitates rotation of seventh pinion gear 210, which facilitates rotation of six spur gear 208. The rotation of six spur gear 208 facilitates concurrent rotation of both eighth pinion gear 218 and inner cam 214 which are attached thereto. The eighth pinion gear 218 rotates within the opening 199 of the motor mount plate 198, with the inner cam 214 rotating within inner cam receiving slot 216 of inner cam follower 228. Due to inner cam 214 being radially offset from the axis of the six spur gear 208, the rotation of inner cam 214 within inner cam receiving slot 216 facilitates a reciprocal upward and downward vertical movement of the inner cam follower 228. Such reciprocal movement of inner cam follower 228, in turn, results in reciprocal upward and downward pivotal movement of lower jaw plate 188.

As indicated above, it is contemplated that head and mouth animation device 26 of the present invention will be integrated into an animated figure such as a doll or a soft toy animal. In this application, the lower jaw plate 188 will be disposed within the doll or soft toy animal head and cooperatively engaged to a moveable lower jaw thereof. The opposed ends of jaw tube 192 are pivotally connected to jaw connecting pins 189 fixed on left side vertical support member 244 and right side vertical support member 246 (see FIG. 25). The upward vertical movement of inner cam follower 228, as a result of the rotation of inner cam 214, facilitates downward pivotal movement of the lower jaw plate 188, and hence the movement of the animated doll mouth to an "open mouth" position. Conversely, the downward movement of inner cam follower as a result of the rotation of inner cam 214 results in upward pivotal movement of the lower jaw plate 188, and hence, movement of the animated doll mouth to a "closed mouth" position.

As further seen in FIGS. 25–30, head and mouth animation device 26 also includes a seventh spur gear 220 which is rotatably mounted to second pin 264. Contiguously attached to and extending axially from a side seventh spur gear 220 is a cylindrically configured cam receiving boss 222 having a diameter which is substantially less than that of seventh spur gear 220. It is noted that receiving boss 222 is radially centered about an axis defined by second pin 264. Also contiguously attached to and extending from the same side of seventh spur gear 220 is annular outer cam 224. However, annular outer cam 224 is radially offset such that receiving boss 222 does not extend axially through the center of annular outer cam 224, but rather is offset toward one side thereof. Eighth pinion gear 218 is intermeshed and drives with the seventh spur gear 220 such that the rotation of eighth pinion gear 218 will facilitate concurrent rotation of seventh spur gear 220. The rotation of seventh spur gear 220 facilitates the rotation of annular outer cam 224 due to the coupling of annular outer cam 224 to seventh spur gear 220.

Operatively coupled to annular outer cam 224 is outer cam follower 226 having a circularly configured primary opening 227 and a smaller, circularly configured secondary opening 229. Due to annular outer cam 224 being offset from the axis define by second pin 264 and of which seventh spur gear 220 is centered, the rotation of the seventh spur gear 220 facilitates a back and forth reciprocal movement of outer cam follower 226 which induces motion in the head and mouth animation device which is described in more detail below.

The aforementioned drive train components are disposed between a front inner casing 234 and a rear inner casing 236 of the head and mouth animation device 26. Disposed in the approximate center of the front inner casing 234 is inner casing boss 238 having an aperture extending axially therethrough which is sized and configured to receive and rotatably support a forward end of first pin 262. Also disposed within the front inner casing 234 is front inner casing receiving aperture 239 which is laterally offset from inner casing boss 238 and is configured to receive and rotatably support the forward end of first pin 236. Similarly, disposed within the approximate center of the rear inner casing 264 is rear inner casing boss 237 having an aperture extending axially therethrough which is sized to receive and rotatably support a rear end of the first pin 262. Also disposed within the rear inner casing 264 is rear inner casing pin receiving aperture 240 which is sized and configured to receive and rotatably support the second pin 264. As will be discussed in more detail below, the second pin 264 is sized such that it is advanced through rear inner casing pin receiving aperture 240. Next, it is observed that left side vertical support member 244 and right side vertical support member 246 are clamshelled together and attached to an upper structure 233 which projects upwardly from the front inner casing 234. Fastened to a pair of attaching bosses 245 located on a mid-section of vertical support members 244, 246 are left semi-circular structure 248 and right semi-circular structures 250, each having a respective pair of boss receivers 249 which accept attaching bosses 245. Moreover, integrally formed above the attaching bosses 245 on both left side vertical support member 244 and right side vertical support member 246 are rail receiving members 247 which are adapted to receive rear support member 242 is a slidable manner.

Figure 25:
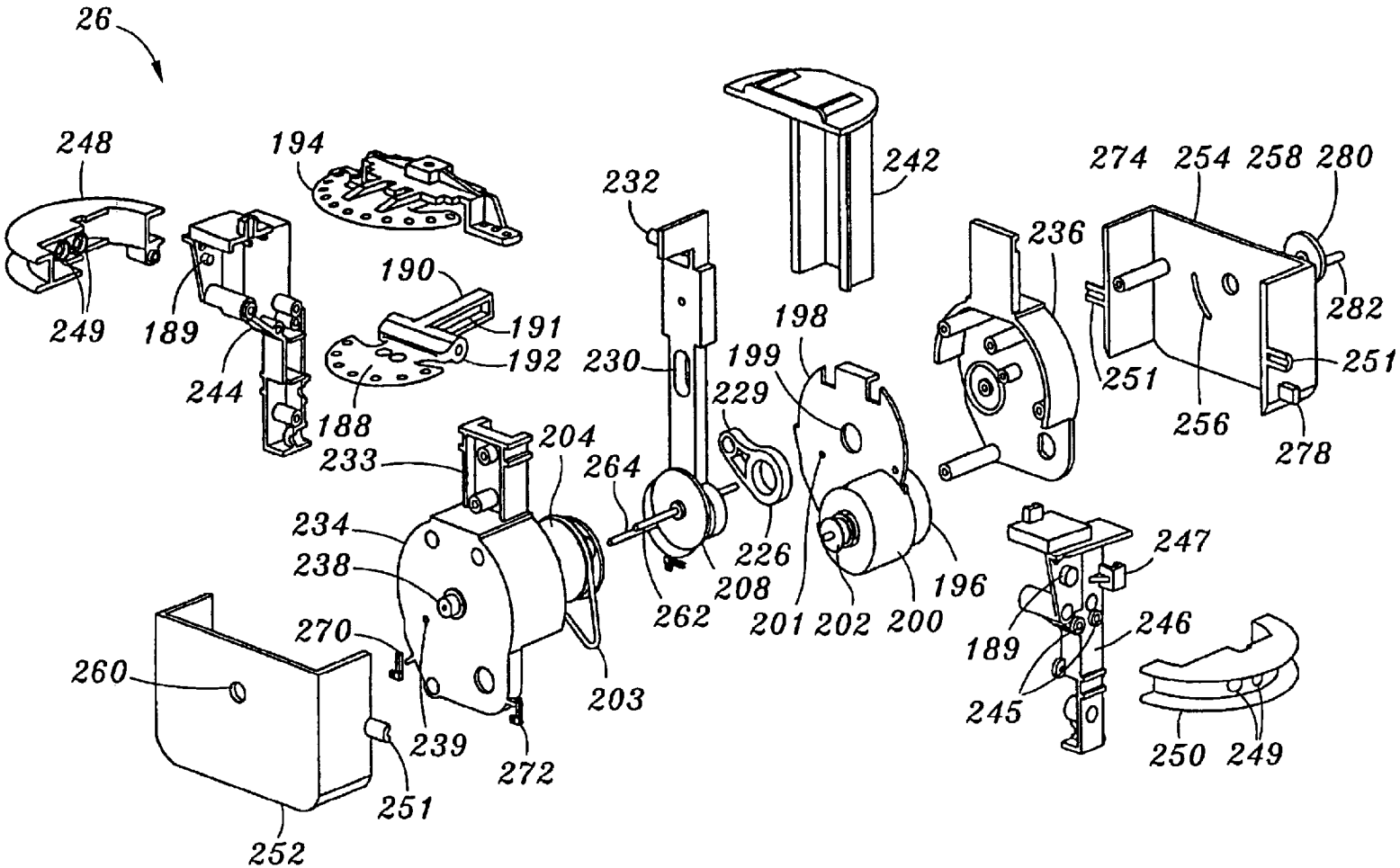
FIG. 25 is an exploded view of the head and mouth animation device from a front upper right side perspective.

As seen in FIG. 25, attached to the motor mount plate 198 below the inner cam follower 228 is a mouth contact switch 268. The downward movement of the inner cam follower 228 to the closed mouth position will facilitate contact between the bottom end of the inner cam follower 228 and the mouth contact switch 268 in a manner actuating the mouth contact switch 268. The actuation of the mouth contact switch 268 transmits a signal to the control circuitry 286 (see FIG. 31) of the animation device 2 indicative of the downward movement of the inner cam follower 228 to its downward limit, and hence the movement of the lower jaw plate 188 to the full, closed mouth position. Additionally, as seen in FIGS. 25 & 27, formed on opposite sides of the lower portion of the front inner casing 234 is a left contact switch actuator 270 and a right contact switch actuator 272, the use of which will be discussed in more detail below.

In the upper motion unit 26, the front and rear inner casings 234, 236 are disposed between and rotatably connected to a front middle casing 252 and a rear middle casing 254. Disposed within the front middle casing 253 is a front casing aperture 260, while disposed within the rear middle casing 254 is a rear casing aperture 258. Also disposed within the rear middle casing 254 in spaced relation to rear casing aperture 258 is a second arcuate receiving slot 256. Additionally, formed on and extending inwardly from the inner surface of the rear middle casing 254 is an elongate, cylindrically configured outer cam receiving boss 274. Further, formed on and extending outwardly from one side wall of the front middle casing 252 is a front contact switch actuator 276 (see FIG. 26). Similarly, formed on and extending outwardly from one side wall of the rear middle casing 254 is a rear contact switch actuator 278. The use of the front and rear contact switch actuators 276, 278 will be described in more detail below.

In the upper motion unit 26, the inner casing boss 238 protruding from the front inner casing 234 is advanced into and rotatably supported within front casing aperture 260. Similarly, rear inner casing boss 237 protruding from the rear inner casing 236 is advanced into and rotatably supported within the aperture 258. The receipt of the bosses 238, 237 into respective ones of the apertures 260, 258 facilitates a rotatable connection of the attached front and rear inner casings 238, 236 to the receptacle collectively defined by the attached front and rear middle casings 252, 254. When such rotatable connection is achieved, the second pin 264, in addition to being extended through rear inner casing pin receiving aperture 240, is also extended through the second arcuate receiving slot 256, with a portion of the second pin 264 protruding therefrom in which circularly configured exterior cam 280 (see FIGS. 25 & 26) is coupled, via exterior cam pin receiving aperture 281, to the end portion of second pin 264. Attached to and extending outwardly from exterior cam 280 is a cylindrically configured cam extension 282 which is radially offset from the exterior cam pin receiving aperture 281, and hence, the axis of exterior cam 280.

When the front and rear inner casings 234, 236 are attached to each other, only a portion of outer cam follower 226 is disposed therebetween, with the segment of outer cam follower 226 defining the secondary opening 229 protruding from the attached front and rear inner casings 234, 236. When front and rear inner casings 234, 236 are rotatably connected to the front and rear middle casings 252, 254 in the above-described manner, cam boss 274 of the rear middle casing 254 is advanced into and through the secondary opening 229 of the outer cam follower 229. As indicated above, annular outer cam 224 may be rotated by the second reversible electric motor 196 to facilitate the movement of outer cam follower 226 to one side or the other. Such movement effectively causes the joined front and rear inner casings 234, 236 (and hence the figure's head) to pivot (rock or tilt) along an arcuate path between right and left positions relative to the joined front and rear middle casings 252, 254. Importantly, the shape of second arcuate receiving slot 256 accommodates the resultant movement of the second pin 264 in an arcuate path relative to the joined front and rear middle casings 252, 254. Thus, the exterior cam 280 which is at the exterior of the joined front and rear middle casings 252, 254 moves with the second pin 264 along its arcuate path, in addition to being rotated thereby. Thus, the rotation of annular outer cam 224 and resultant movement of outer cam follower 226 allows the components of upper motion unit 26 interfaced to and supported by the front and rear inner casings 234, 236 to be moved relative to the front and rear middle casings 252, 254 along an arcuate path between right and left positions.

Now referring back to FIGS. 11 & 12, front chest 18 and back chest 20 are adapted to integrally receive and fasten upper motion unit 26 within the cavity defined by the front chest 18 and back chest 20. Formed within the back chest 20 on the inner surface of the back wall of the rear outer casing 120 is exterior cam follower slot 19. When the front chest 18 and back chest 20 are sandwiched together to unify the main structure of the upper assembly 4, the cam extension 282 of exterior cam 280 is advanced into exterior cam follower slot 19 (see also FIG. 2). As indicated above, the second reversible electric motor 196 not only facilitates the rotation of the cam extension 282 about the axis of the second pin 264, but also the movement of the cam extension 282 along the arcuate path defined by the second arcuate receiving slot 256. When the cam extension 282 is advanced into the interior of the exterior cam follower slot 19 in the above-described manner, the rotation and arcuate movement of the exterior cam 280 causes the cam extension 282 to act against the exterior cam follower slot 19 in a manner facilitating the tilting or pivoting movement of the joined front and rear middle casings 252, 2524 (and hence the figure's head) along an arcuate path between forward and backward positions relative to the joined front chest 18 and back chest 20.

G. Description of Exemplary Control Circuitry

Figure 31:
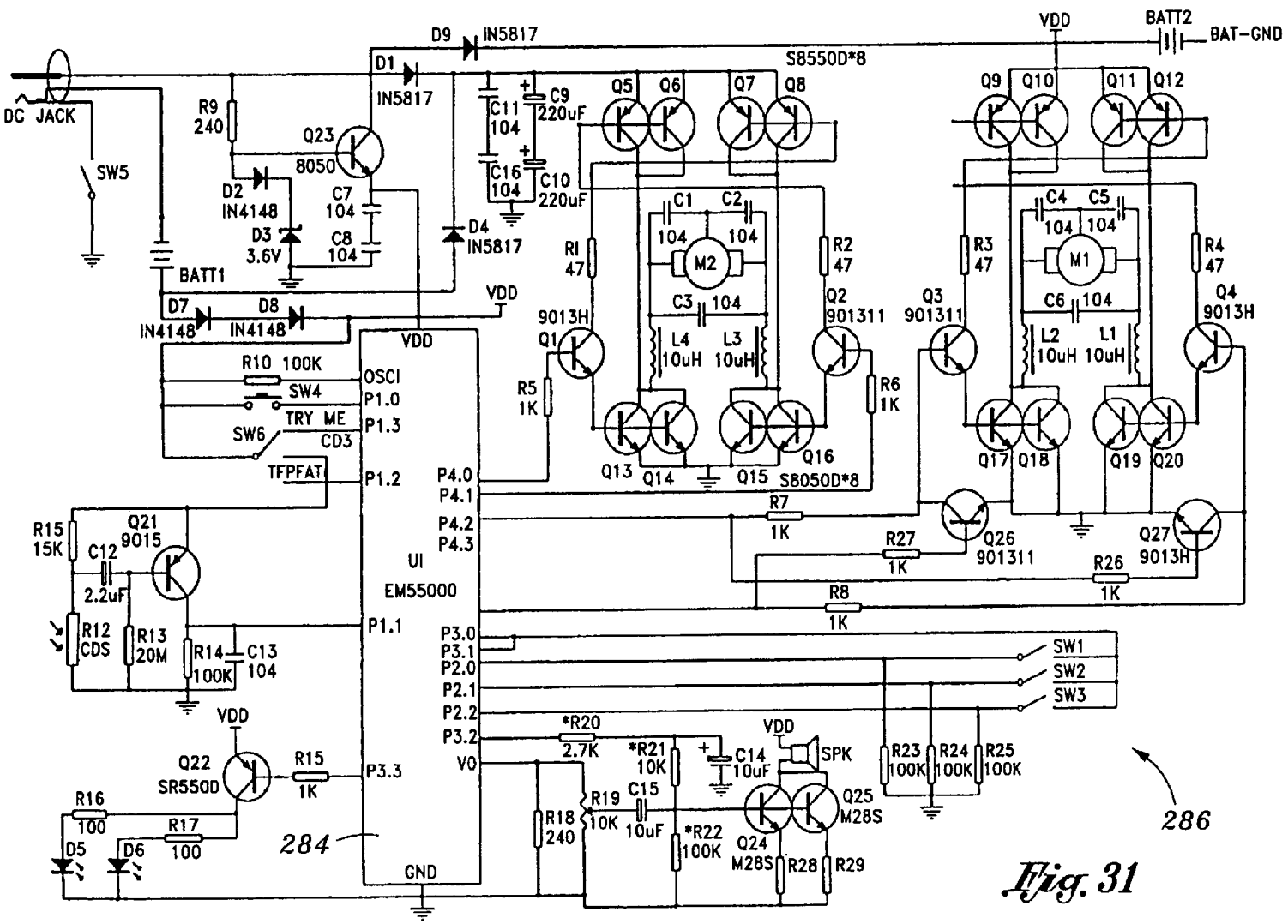
FIG. 31 provides a schematic of exemplary control circuitry which may be used to control and coordinate the various movements of the animation device

FIG. 31 provides a schematic of exemplary control circuitry 286 which may be used to control and coordinate the various movements of the animation device 2 as described above. The control circuitry 286 includes a microprocessor or central processing unit 284 which is programmable, and provided with power from a power source (e.g., batteries or electrical plug) of the animated figure, soft toy animal or doll. Advantageously, the configuration of the animation device 2 imparts various movement capabilities to the head, mouth, arms and body of the animated figure, soft toy animal or doll. The control circuitry 286 may be programmed to facilitate these movements in any combination or sequence. The facilitation of such movements at the same time in a desired sequence achieves a realistic, life-like animated appearance with the animated figure, soft toy animal or doll. Advantageously, these attributes are achieved through the use of only two motors (i.e., first reversible electric motor 76 and second reversible electric motor actuation motor 196). As will be recognized, the relative simplicity of construction of the animation device 2 reduces the costs thereof, and hence the costs of the animated figure, soft toy animal or doll into which it is incorporated, despite providing an extremely high level of movement/animation capability.

H. Description of Exemplary Motion of Exemplary Embodiment of Animation Device for Head, Mouth, Arms and Body of Toy Based on the aforementioned description of the animation device for head, mouth, arms and body of toy, the motion of the exemplary embodiment is now described herewith. Initially it should be noted once again that movement of the present invention is programmable within central processing unit 284. Therefore, the animation device may perform an unlimited number of dancing routines as long as the motion fits within the allowable degrees of freedom provided by animation device 2.

Figure 2:
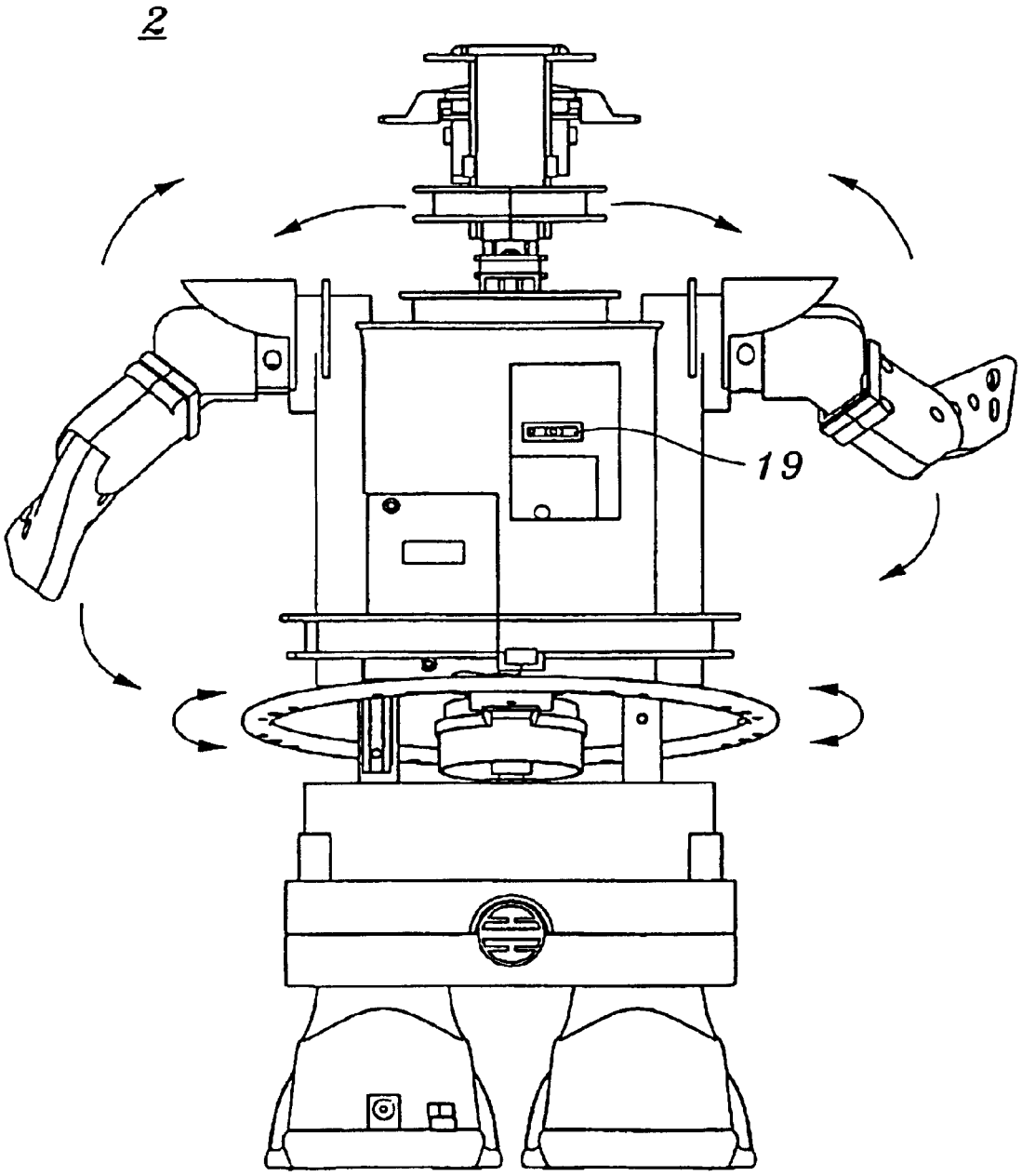
FIG. 2 is a rear view of the exemplary embodiment of the animation device.
Figure 3:
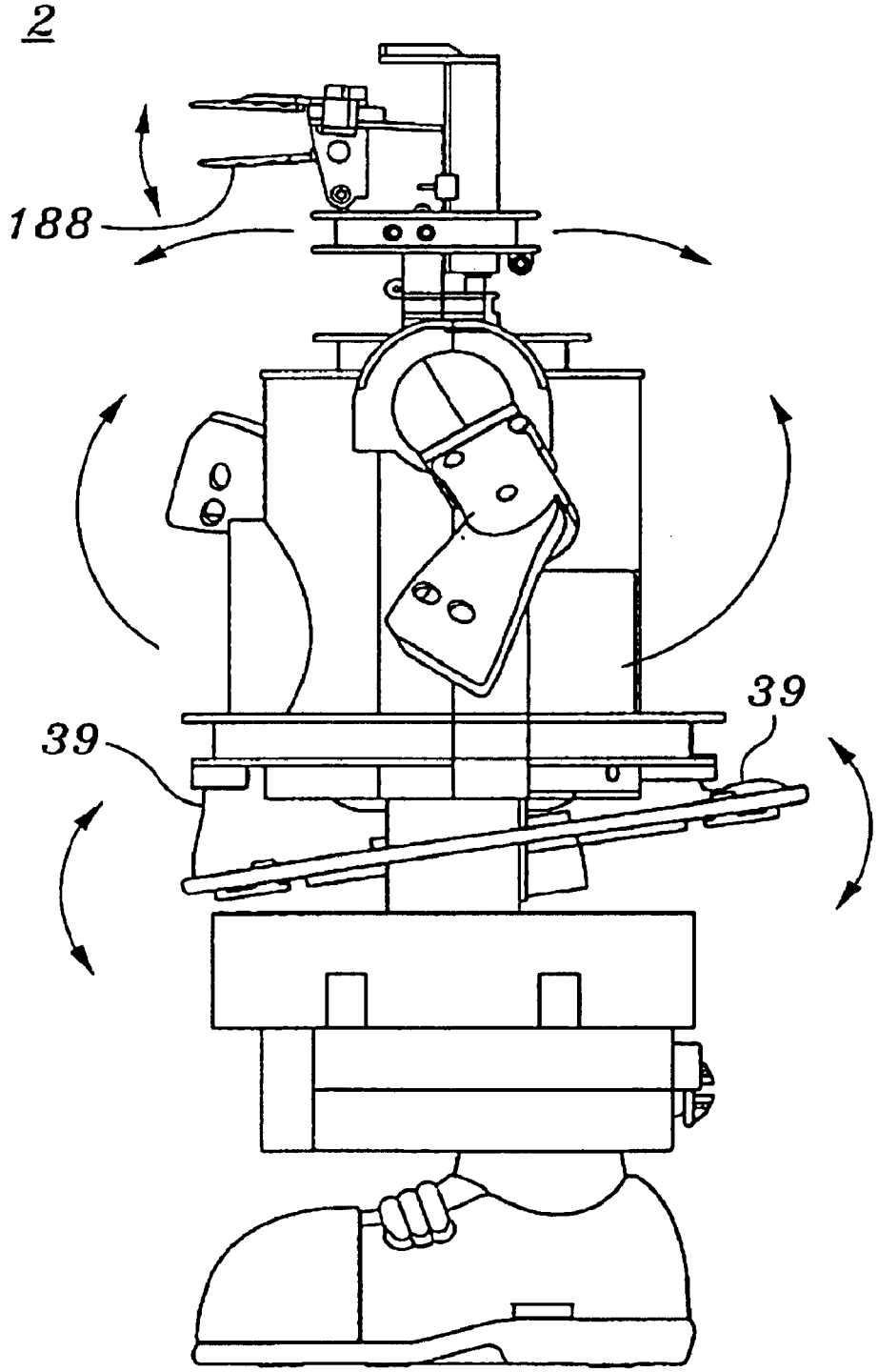
FIG. 3 is a left side view of the exemplary embodiment of the animation device.
Figure 4:
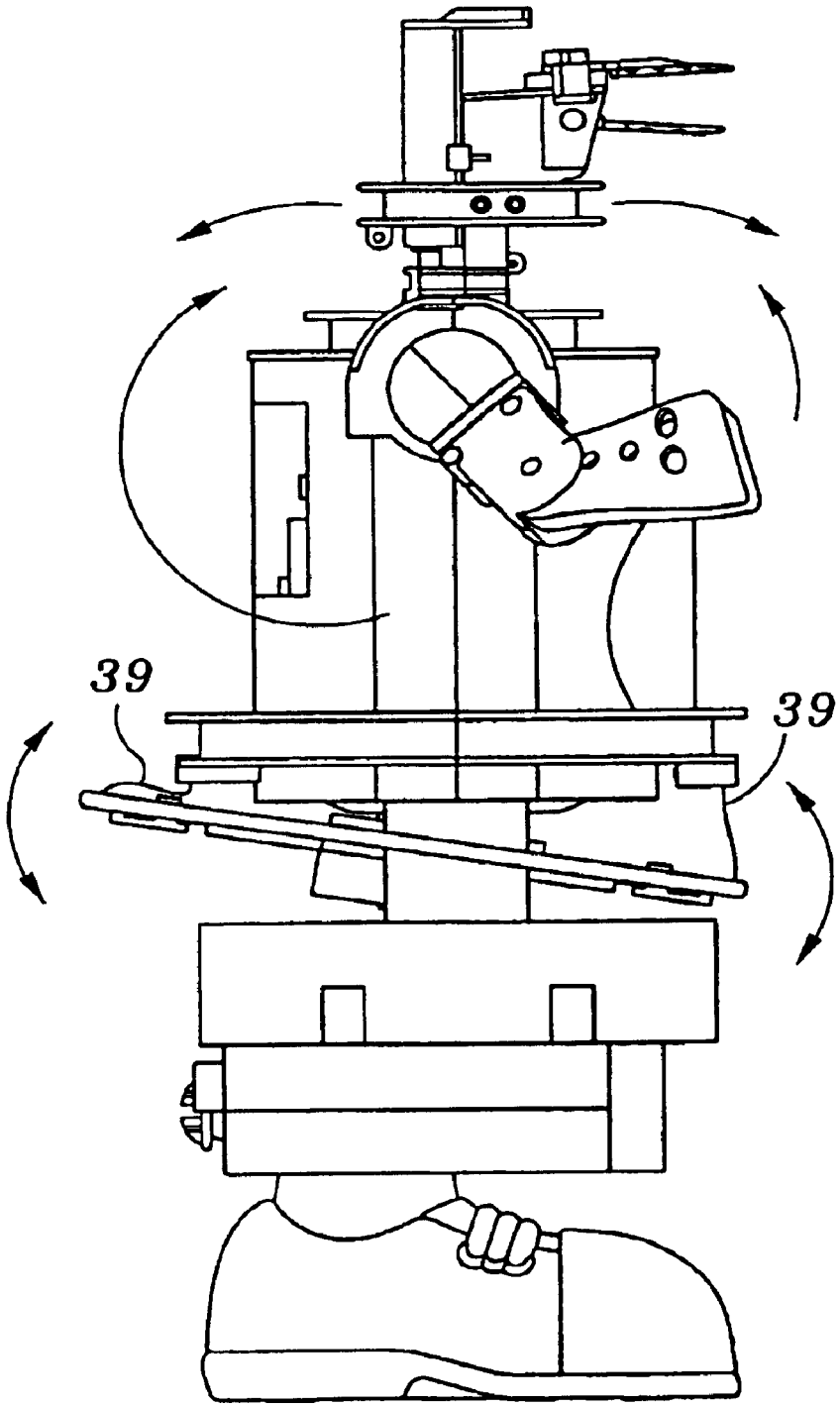
FIG. 4 is a right side view of the exemplary embodiment of the animation device.
Figure 5B:
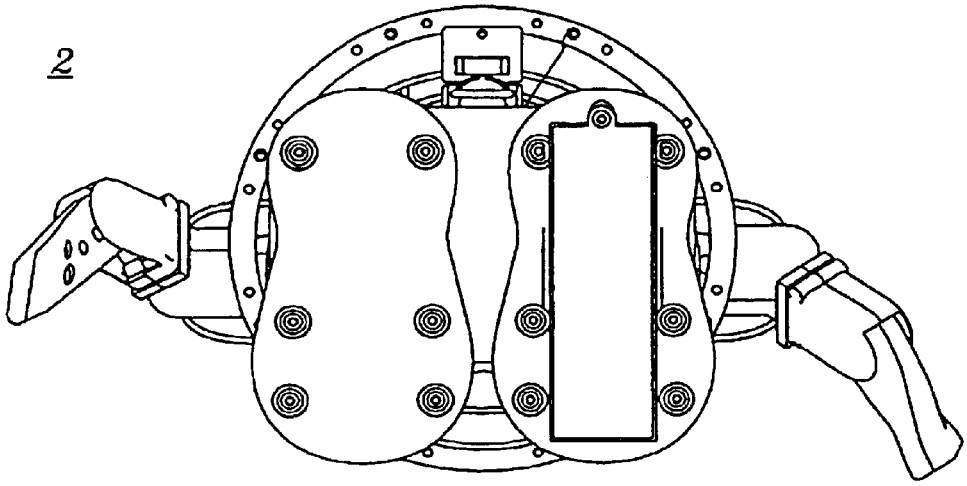
FIG. 5B is a bottom view of the exemplary embodiment of the animation device.
Figure 5A:
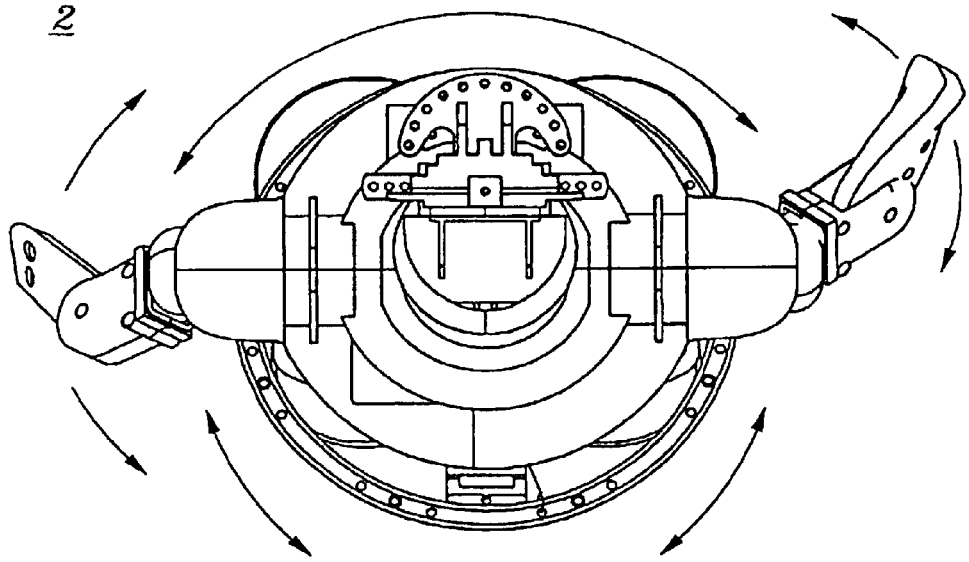
FIG. 5A is a top view of the exemplary embodiment of the animation device.
Figure 20:
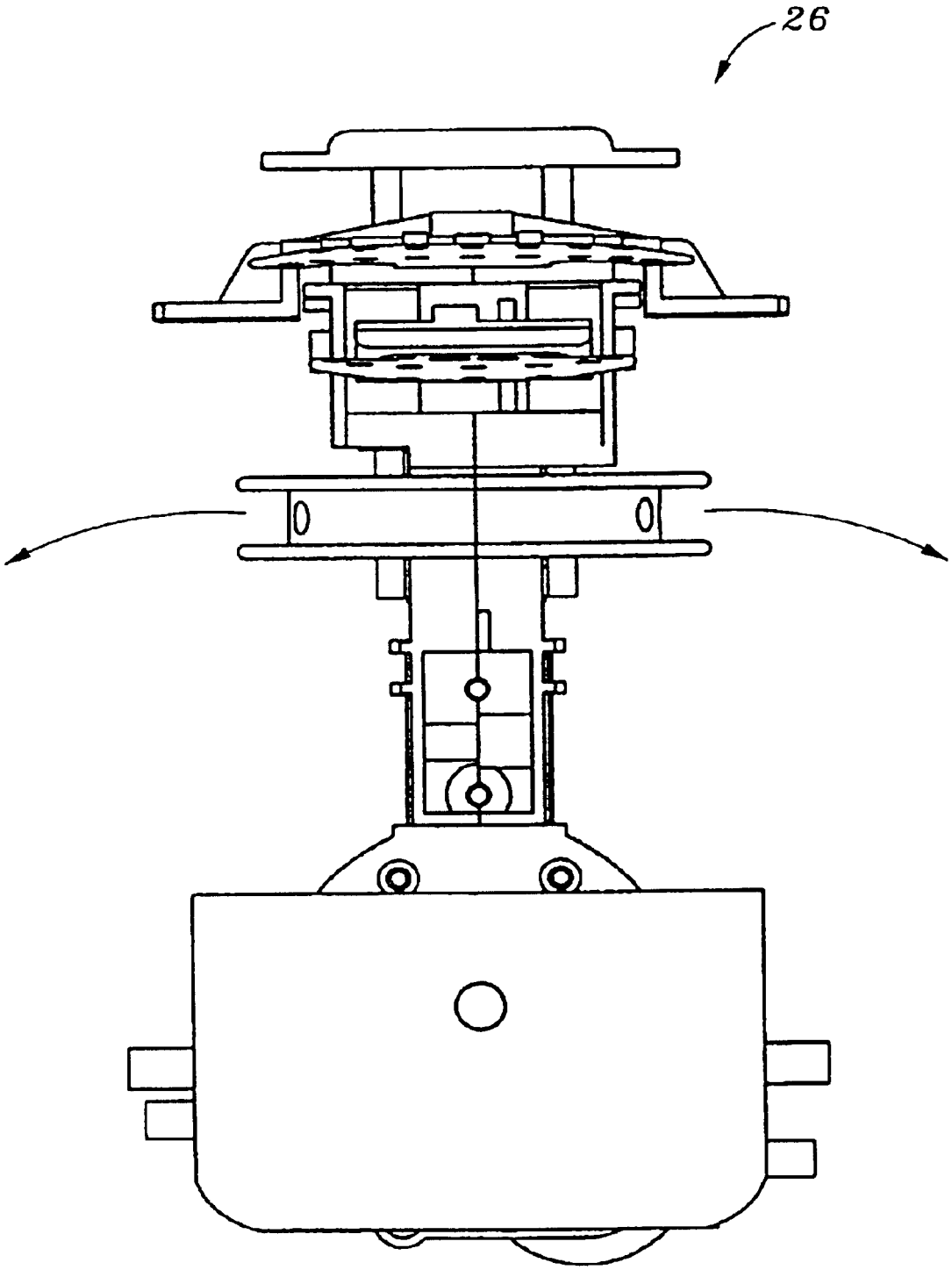
FIG. 20 is a front view of the head and mouth animation device utilized in the exemplary embodiment of the animation device.
Figure 21:
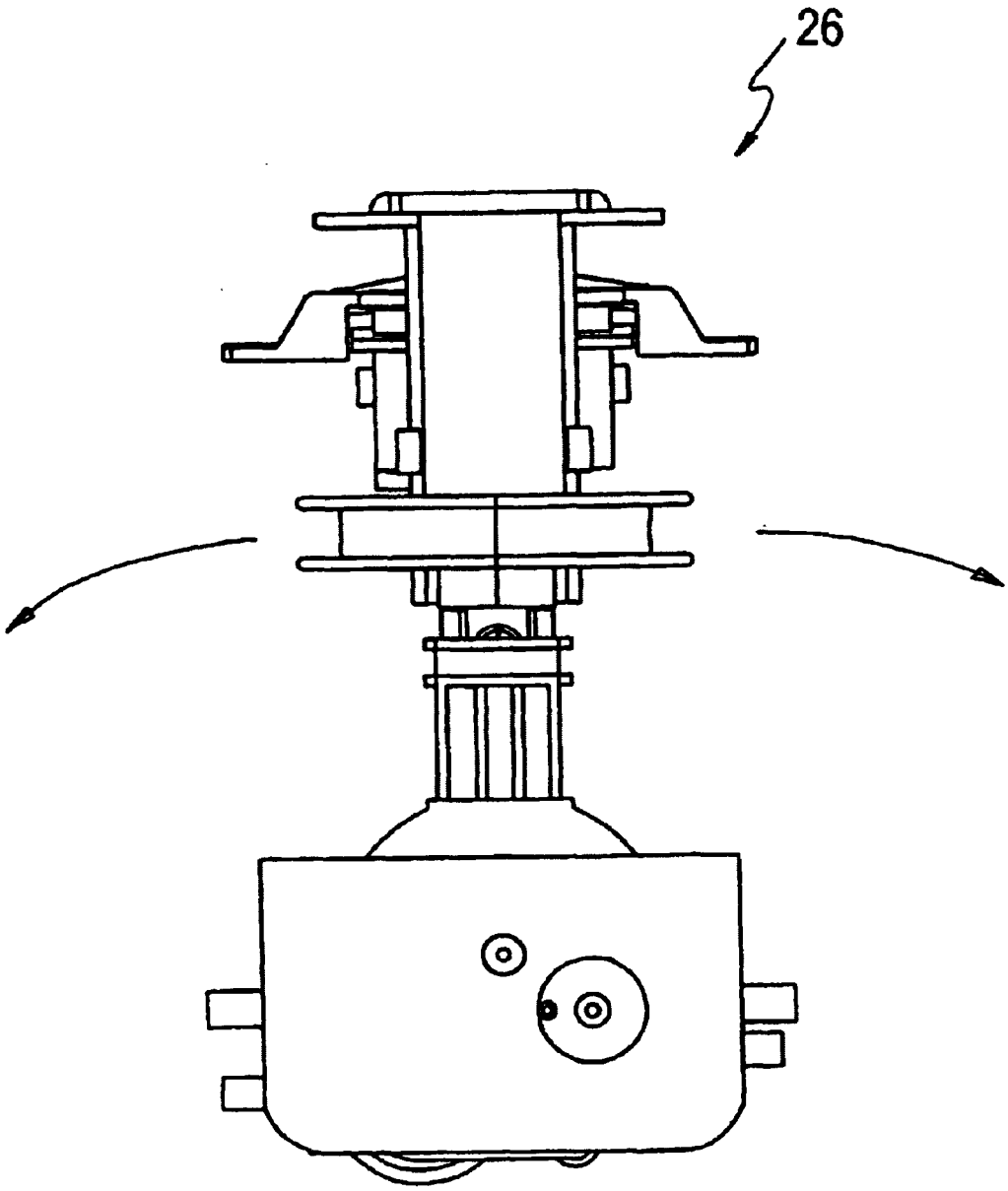
FIG. 21 is rear view of the head and mouth animation utilized in the exemplary embodiment of the animation device.
Figure 22:
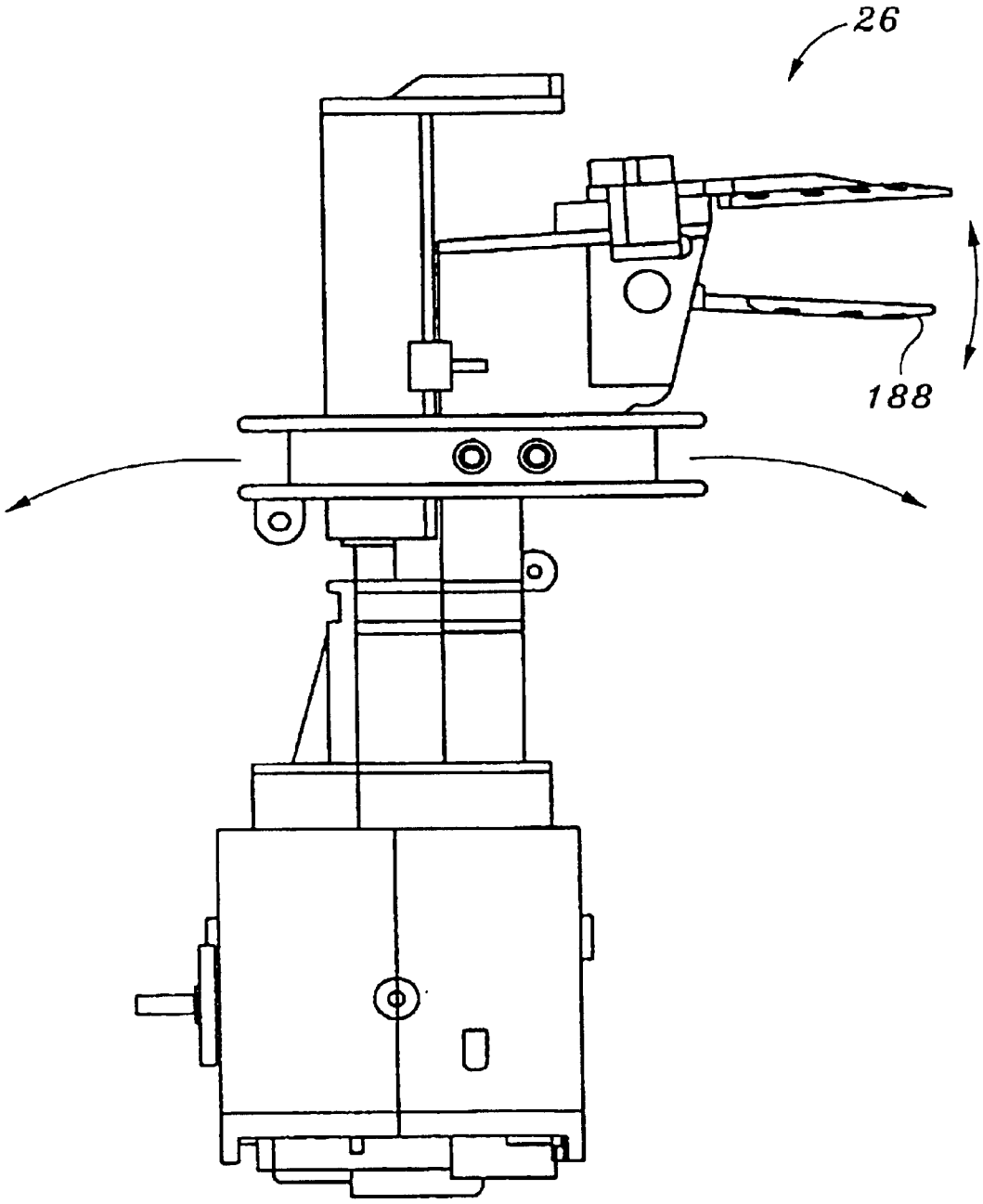
FIG. 22 is right side view of the head and mouth device utilized in the exemplary embodiment of the animation device.
Figure 23:
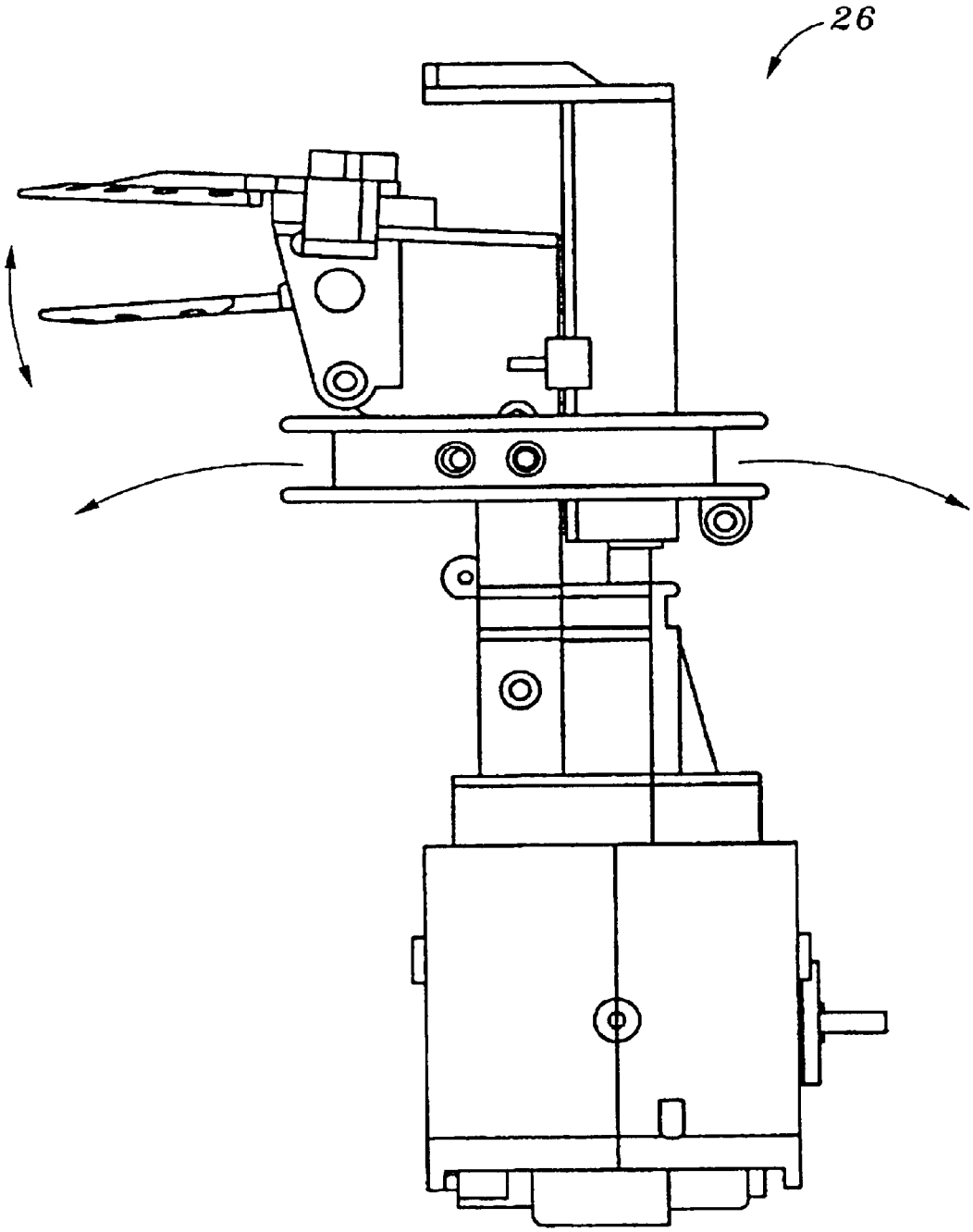
FIG. 23 is right side view of the head and mouth animation device utilized in the exemplary embodiment of the animation device.

There are three degrees of freedom with respect to movements derived from the head and mouth animation 26 device of the exemplary embodiment. A first type of movement is from lower jaw 188 between open and closed mouth positions as is illustrated in FIGS. 2, 3, 22 and 23. Such movement may be coordinated with audio played from speaker 42 to simulate a character speaking or singing. A second type of movement is tilting of inner cam follower 228, rear support member 242, front and rear inner casing 234, 236, left and right side vertical support members 244, 246, left and right semi-circular structures 247, 249, lower jaw plate 188, and upper fixed jaw 194. This produces a simulated back and forth tilting of a head and neck region of the figure. Such back and forth tilting is illustrated in FIGS. 3, 4, 22, and 23. The third type of motion is includes tilting the previously mentioned components of the head and neck to the right or to the left, which is illustrated in FIGS. 2, 20, and 21.

There are also three degrees of freedom with respect to movements derived by lower drive unit 24 of the exemplary embodiment. A first type of movement is twisting or rotational movement of upper assembly 4 about the second axis 109. The second type of movement is up and down, swing back and forth movement of the arm assemblies 28, 30 which resembles the motion of a human's arms when the human is running. This motion is depicted in FIGS. 2–5 and 9. The third type of motion is movement of midbody perimeter hoop 32 in a twisting, up and down, gyrating and erratic jerking motion of the midbody perimeter hoop 32.

I. Operation of Exemplary Embodiment of Animation Device for Head, Mouth, Arms and Body of Toy Animation device 2 may be powered from a battery source or from an external electrical source which plugs into electrical cord receptacle 144 located in the back of left shoe 134. There are two battery compartments in the animation device 2, battery enclosure 180 located in right shoe 136, and battery case 115 located in lower assembly 6. Battery enclosure 180 holds four 1.5V alkaline "AA" batteries. Battery case 115 holds four 1.5V alkaline "C" batteries.

To operate animation device 2, the power on/off and volume control 142 should be rotated clockwise to the "On" position to turn animation device 2 on, or counter clockwise to the "Off" position to turn animation device 2 off. Moreover, volume control 142 may be used for adjustment of sound volume from speaker 42.

Furthermore, animation device has three mode settings which may be set by mode selection switch 146, including "Demonstration Mode", "Motion-Activation Mode", and "Button-Activated Mode".

For "Demonstration Mode", mode selection switch 146 is positioned to position "0" and volume control 142 should be turned clockwise towards the "On" position until it clicks on. Then activation button 288 should be pressed (located in the front of the character, see FIG. 10). In this mode, the character will sing and dance for about 20 seconds and then stop.

For the "Motion-Activation Mode", mode selection switch 146 should be positioned to "1" and volume control 142 should be turned to the "On" position. In this mode, the character will sing and dance for about one minute every time someone passes by, then stop and wait for another person to pass by. The animation device 2 is able to sense motion because a motion detector 138 is installed into the upper left shoe toe 184.

For the "Button-Activated Mode", mode selection switch 146 should be positioned to "2" and the volume control 142 should be turned to the "On" position. In this case, the character will start to sing and dance for about one minute and then stop.

Additionally, an embodiment of animation device 2 may include features which allows it to communicate with another animated figures or devices. Such technology is provided in U.S. patent application Ser. No. 10/200,696, filed Jul. 22, 2002, entitled, "Interactive Talking Dolls", the contents of which are expressly incorporated by reference herein in its entirety. For instance an embodiment may include incorporating within animation device 2 an infrared wireless receiver and transmitter. This feature may be utilized for allowing animation device 2 to send and receive data over a wireless connection. Also, the infrared feature may be utilized to have animation device 2 speak to and move in unison with another similar animated device so as to carry out coordinated movements and simulate conversation between a plurality of animated figures.

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed; rather, the invention extends to all functionally equivalent structures, methods, and uses such are within the scope of the appended claims.

LIST OF REFERENCE NUMERALS

2. animation device
4. upper assembly
6. lower assembly
8. left receiving connecting structure
9. fastening apertures
10. right receiving connecting structure
12. left connecting box
14. right connecting box
16. exemplary Christmas tree exterior body
18. front chest
20. back chest
21. right shoulder bearing
22. back chest cover
23. left shoulder bearing
24. lower drive unit or gear box assembly
25. journal caps
26. head and mouth animation device
28. left arm assembly
30. right arm assembly
32. midbody perimeter hoop
34. outer frame
36. inner hub
38. spokes
39. hoop string
40. hoop movement cam or middle cam
41. string fasteners
42. speaker
44. arm assembly
46. shoulder axle
48. inboard retaining boss
50. input cam
51. arm movement link
52. output cam
53. swivel elbow joint
54. arm link
55. inner elbow boss
56. forearm cam
57. elbow joint aperture
58. forearm follower
62. front shoulder clam shell
64. rear shoulder clam shell
66. input cam journal
68. output cam journal
70. inner arm clamshell
72. outer arm clamshell
74. forearm follower cover
75. first motor pulley
76. first reversible electric motor
78. drive unit base
80. drive unit cover
81. cam linkage connector
82. left cam
84. right cam
86. first drive belt
88. first drive pulley
90. pulley axle
92. first pinion gear
94. first spur gear
96. second spur gear
97. second spur gear shat
98. third pinion gear
100. spur & pinion clutch
102. first axle drive gear
104. second axle drive gear
106. first axle
107. first axis
108. second axle
109. second axis
110. cylindrical receiving bracket
111. waist movement actuation lever
112. upper housing

113. waist movement switch
114. lower housing
115. battery case
116. release fastener
117. first enclosure
118. housing collar
119. second enclosure
120. waist roller
121. actuation rod
122. waist roller receiver
123. lower cam retainment boss
124. lower cam
125. central cylindrical mount
126. gear train
128. revolving plate
129. plate center axial receiving bore
130. clutch release mechanism
131. fastening dowel
132. plate retaining ring
133. shoe fastening boss
134. left shoe
136. right shoe
138. motion detector
139. waist movement cam receiving boss
140. arcuate shaped lower cam receiving slot
141. planar base
142. power on/off and volume control
143. central receiving base
144. electrical cord receptacle
146. mode selection switch
148. third axle
149. third axis
150. fourth pinion gear
152. third spur gear
154. fifth pinion gear
156. fourth spur gear and sixth pinion gear (not shown)
158. fourth axle
160. third drive gear
162. gear train cover
164. gear train box
165. lower clutch receiving boss
166. lower clutch coupler
168. upper clutch coupler
170. engagement spring
172. engagement ring
174. upper right shoe body
175. upper right shoe toe
176. right shoe sole
178. battery enclosure door
180. battery enclosure
182. upper left shoe body
184. upper left shoe toe
186. printed circuit board
188. lower jaw plate
189. jaw connecting pins
190. jaw support
191. jaw receiving slot
192. jaw tube
194. upper fixed jaw
196. second reversible electric motor
198. motor mount plate
199. circular configured opening
200. second cylindrical receiving bracket
201. bracket pin aperture
202. second motor pulley
203. second drive belt
204. second drive pulley
206. sixth pinion gear
208. sixth spur gear
210. seventh pinion gear
212. fifth spur gear
214. inner cam
216. inner receiving slot
218. eighth pinion gear
220. seventh spur gear
222. cam receiving boss
224. annular outer cam
226. outer cam follower
227. primary opening
228. inner cam follower
229. secondary opening
230. inner cam follower receiving slot
232. jaw connecting link
233. front inner casing upper structure
234. front inner casing
236. rear inner casing
237. rear inner casing boss
238. inner casing boss
239. front upper casing pin receiving aperture
240. rear inner casing pin receiving aperture
242. rear support member
244. left side vertical support member
245. attaching bosses
246. right side vertical support member
247. rail receivers
248 left semi-circular structure
250. right semi-circular structure
251. swivel boss
252. front middle casing
253. vertical mounting brackets
254. rear middle casing
255. swivel boss journal
256. second arcuate receiving slot
258. rear casing aperture
260. front casing aperture
262. first pin
264. second pin
268. mouth contact switch
270. left contact switch actuator
272. right contact switch actuator
274. outer cam receiving boss
276. front left contact switch actuator
277. front right contact switch actuator
278. rear contact switch actuator
280. exterior cam
281. exterior cam pin receiving aperture
282. cylindrically configured cam extension
284. central processor unit or microprocessor
286. control circuitry
288. activation button

What is claimed:

1. An animation device for generating movements of limbs and extremities of an animated figure, said animation device comprising:

a single motor coupled to a gear box assembly;

a first drive axle coupled to said gear box assembly, said first drive axle rotatable about a first axis;

a second drive axle coupled to said gear box assembly, said second drive axle rotatable about a second axis, said second drive axle oriented substantially perpendicular to said first drive axle;

a gear train assembly coupled to a lower end of said second drive axle;

an output drive shaft coupled to said gear train assembly, said output drive shaft rotatable about a third axis oriented parallel to and offset from the second axis;

a left cam coupled to a left end of said first drive axle and a right cam coupled to a right end of said first drive axle, said left and right cam configured for radial movement about said first drive axle when said motor is activated;

a middle cam coupled to a middle section of said second drive axle, said middle cam configured for radial movement about said second drive axle when said motor is activated; and a lower cam coupled to said output drive shaft, said lower cam configured for radial movement about said output drive shaft when said motor is activated.

2. The animation device according to claim 1, said left cam cooperatively attached to a left arm movement link cooperatively attached to a left arm assembly, wherein motion is induced in said left arm assembly when said motor is activated.

3. The animation device according to claim 1, said right cam cooperatively attached to a right arm movement drive link cooperatively attached a right arm assembly, wherein motion is induced in said right arm assembly when said motor is activated.

4. The animation device according to claim 2, said left arm assembly containing a left shoulder axle having a left inboard retaining boss rotatably attached to a left shoulder bearing journal fixed to said animation device forming a left shoulder joint, a left input cam coupled to a center section of said left shoulder axle, said left input cam swivel attached to an upper end of said left arm movement link, a left output cam coupled to an outboard end of said left shoulder axle, said left output and input cams configured for simultaneous radial movement about said left shoulder axle, a left arm link swivel attached to said left output cam, and a left forearm cam having a left forearm follower integrally formed with said left forearm cam, wherein motion is induced in said left forearm follower when said motor is activated.

5. The animation device according to claim 3, said right arm assembly containing a right shoulder axle having a right inboard retaining boss rotatably attached to a right shoulder bearing journal fixed to said animation device forming a right shoulder joint, a right input cam coupled to a center section of said right shoulder axle, said right input cam swivel attached to an upper end of said right arm movement link, a right output cam coupled to an outboard end of said right shoulder axle, said right output and input cams configured for simultaneous radial movement about said right shoulder axle, a right arm link swivel attached to said right output cam, and a right forearm cam having a right forearm follower integrally formed with said right forearm cam, wherein motion is induced in said right forearm follower when said motor is activated.

6. The animation device according to claim 1, said hoop movement cam cooperatively attached to an inner hub connected to a midbody perimeter outer frame by a plurality of spokes, said hoop movement cam inducing at least one of gyrating, jerking, tilting, up and down, and rotating movement of said midbody perimeter outer frame when said motor is activated.

7. The animation device according to claim 1, said lower cam cooperatively attached to an arcuate shaped lower cam receiving slot formed in a planar surface of a housing assembly, said receiving slot inducing an upper assembly of said animation device to rotate in a back and forth motion about the second axis when said fourth cam is radially rotated about the third axis when said motor is activated.

8. An animation device for generating movements of limbs and extremities of the animated figure, said animation device comprising:

a lower motion unit, an upper motion unit, and a chassis adapted to internally house and support said lower and upper motion units;

said lower motion unit comprising, a first motor coupled to a gear box assembly;

a first drive axle coupled to said gear box assembly, said first drive axle rotatable about a first axis;

a second drive axle coupled to said gear box assembly, said second drive axle rotatable about a second axis, said second drive axle oriented substantially perpendicular to said first drive axle;

a gear train assembly coupled to a lower end of said second drive axle;

an output drive shaft coupled to said gear train assembly, said output drive shaft rotatable about a third axis oriented parallel to and offset from the second axis;

a left cam coupled to a left end of said first drive axle and a right cam coupled to a right end of said first drive axle, said left and right cam configured for simultaneous radial movement about the first drive axle when said first motor is activated;

a middle cam coupled to a middle section of said second drive axle, said middle cam configured for radial movement about the second drive axle when said first motor is activated; and a lower cam coupled to said gear train assembly, said lower cam configured for radial movement about the third axis when driven by said first motor; and said upper motion unit comprising, an upper cam cooperatively engaged to a jaw, the upper cam configured for linear movement along a fourth axis concurrently with pivotal movement about fifth and six axes which are both normal to the fourth axis and to each other; and a second motor coupled to the upper cam and operative to facilitate the movement thereof along the fourth axis concurrently with movement about the fifth and sixth axes.

9. The animation device according to claim 8, wherein the upper cam cooperatively engages to said jaw such that movement of said upper cam about the fourth axis facilitates movement of said jaw between open and closed positions, the movement of said upper cam about the fifth axis facilitating movement of a head portion in an arcuate path between left and right positions, and movement of the upper cam about the sixth axis facilitating movement of said head in an arcuate path between forward and backward positions.

10. The animation device according to claim 8, said left and right cam each having an arm movement link cooperatively connected to a respective left and right moveable arm to produce a back and forth swinging motion in said moveable arms.

11. The animation device according to claim 8, said middle cam cooperatively connected to an inner hub of a midbody perimeter hoop to produce at least one of a twisting, up and down, gyrating and erratic jerking motion of said midbody perimeter hoop.

12. The animation device according to claim 9, a center axis of said midbody perimeter hoop being offset from the second axis, and furthermore, the center axis being tilted with respect the second axis.

13. The animation device to claim 8, said lower motion unit, upper motion unit, and chassis comprising an upper assembly of said animation device, and said animation device further comprising a lower assembly including a housing having a planar base covered by a revolving plate interconnected to a bottom side of said upper assembly.

14. The animation device according to claim 13, said lower cam engaged to an arcuate shaped receiving slot integrally formed within said planar base to produce a back and forth rotational motion of said upper assembly about the second axis.

15. An animation device comprising:

a body composed of an upper assembly, midbody section, and lower assembly, said upper assembly having a moveable head with a movable lower jaw hinged to said head, and pair of moveable arms cooperatively attached to a respective pair of shoulders on said upper assembly, said upper assembly further comprising, an upper drive unit disposed within said upper assembly having a first electric motor coupled to a first gear train, said first gear train coupled to a first at least one cam and follower set, said first at least one cam and follower set cooperatively connected to said moveable head and said lower jaw to produce up and down jaw movement and tilting of said head in a back and forth direction and side to side direction;

a lower drive unit disposed within said upper assembly having a second electric motor coupled to a second gear train, said second gear train coupled to a second at least one cam and follower set cooperatively connected to said pair of moveable arms to produce a back and forth swinging movement in said pair of moveable arms;

said midbody section rigidly connected to said upper assembly and rotatably connected to said lower assembly by a revolving plate, said midbody having a midbody perimeter hoop defining an extremity of said body, said midbody section further comprising a third at least one cam and follower set coupled to said first gear train, said third at least one cam and follower set cooperatively connected to said midbody perimeter hoop to produce at least one of a twisting, up and down, gyrating and erratic jerking motion of said midbody section;

said lower assembly having a base adapted to support said body to a substantially horizontal planar surface, said lower assembly further comprising a third gear train disposed within coupled to a driveshaft coupled to said first gear train, and a fourth at least one cam and follower set cooperatively transferring motion to said revolving plate to produce a back and forth rotation of said upper assembly and said midbody about an axis defined by said driveshaft.

16. The animation device according to claim 15, further comprising a programmable central processing unit for programming at least one of specific dance routines dictated by motions produced by said animation device, specific audible sounds, and operational modes of which said animation device performs.

17. The animation device according to claim 15, further comprising a motion detector which activates said animation device when motion is detected by said detector.

18. The animation device according to claim 15, further comprising an infrared transmitting and receiving feature allowing said animation device to send and receive data over a wireless infrared connection.

19. The animation device according to claim 15, further comprising a body adapted to be exteriorly attached to said animation device.

20. The animation device according to claim 19, said body being a Christmas tree figure.

21. The animation device according to claim 15, further comprising a clutch release mechanism integrated into said driveshaft between said second gear train and said third gear train to prevent damage to said animation device when moving parts of said animated device are inappropriately forced to be moved by a user of the animated device.

22. An animation device comprising:

a first motor coupled to a first gear train having a first and second output shaft, said output shafts configured perpendicular to each other;

a left cam radially connected to a left end of said first output shaft, said left cam driving a left follower to induce motion in a left arm assembly;

a right cam radially connected to a right end of said first output shaft, said right cam driving a right follower to induce motion in a right arm assembly;

a middle cam radially connected to said second output shall, said middle cam driving a middle follower to induce motion in a midbody perimeter hoop; and a first input shaft coupled to a center axis of said middle cam on one end and coupled to a second gear train on the other end, said second gear train having a third output shaft and a lower cam radially connected to said third output shaft, said lower cam interconnected with a lower cam receiving slot for inducing a rotational motion in an upper assembly of said animation device.

23. The animation device according to claim 22, said animation device composed of an upper assembly, midbody section, and lower assembly;

wherein said first motor, first gear train, said left cam, said left follower, said right cam, and said right follower are contained within said upper assembly, and wherein said middle cam, said middle follower, and said midbody perimeter hoop are exteriorly located proximate the midbody section.

24. The animation device according to claim 22, said animation device further composed of a midbody section, and lower assembly;

wherein said first motor, first gear train, said left cam, said left follower, said right cam, and said right follower being contained within said upper assembly, wherein said middle cam, said middle follower, and said midbody perimeter hoop are exteriorly located proximate the midbody section, and wherein said second gear train, said third output shaft, said lower cam, and said lower cam receiving slot are contained within said lower assembly.

25. An animation device comprising:

an upper assembly rotatably interconnected to a lower assembly by a midbody section, said upper assembly comprising, a first motor coupled to a first gear train having a first and second output shaft, said output shafts configured perpendicular to each other;

a left cam radially connected to a left end of said first output shaft, said left cam driving a left follower to induce motion in a left arm assembly;

a right cam radially connected to a right end of said first output shaft, said right cam driving a right follower to induce motion in a right arm assembly;

a middle cam radially connected to said second output shaft, said middle cam driving a middle follower to induce motion in a midbody perimeter hoop, said middle cam, middle cam follower, and midbody perimeter hoop located within the midbody section and between said upper assembly and said lower assembly.

26. The animation device according to claim 25, further comprising a first input shaft coupled to a second gear train having a third output shaft, a lower cam radially connected to said third output shaft, said lower cam interconnected with a lower cam receiving slot for inducing a rotational motion in said upper assembly of said animation device, wherein said second gear train, said lower cam, and said cam lower receiving slot are contained within said lower assembly.

27. The animation device according to claim 25, wherein said middle cam, said middle follower and said midbody perimeter hoop are mounted to an exterior of said animation device proximate of the midbody section.

28. An animation device comprising:

an upper assembly;

a midbody section;

a lower assembly;

a first motor coupled to a first gear train having a first and second output shaft, said output shafts configured perpendicular to each other;

a left cam radially connected to a left end of said first output shaft, said left cam driving a left follower to induce motion in a left arm assembly;

a right cam radially connected to a right end of said first output shaft, said right cam driving a right follower to induce motion in a right arm assembly; and a middle cam radially connected to said second output shaft, said middle cam driving a middle follower to induce motion in a midbody perimeter hoop;

said first motor, said first gear train, said left cam, said left follower, said right cam, and said right follower being contained within said upper assembly, and wherein said middle cam, said middle follower, and said midbody perimeter hoop being exteriorly located proximate said midbody section.

* * * * *